US012429259B2

(12) United States Patent
Han et al.

(10) Patent No.: US 12,429,259 B2
(45) Date of Patent: Sep. 30, 2025

(54) EVAPORATIVE CONDENSER AND AIR CONDITIONER INCLUDING SAME

(71) Applicant: KYUNGDONG NAVIEN CO., LTD, Pyeongtaek-si (KR)

(72) Inventors: Jae Hyun Han, Seoul (KR); Chul Ki Jeong, Seoul (KR); Dong Keun Lee, Seoul (KR); In Soo Hwang, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 164 days.

(21) Appl. No.: 18/253,855

(22) PCT Filed: Nov. 26, 2021

(86) PCT No.: PCT/KR2021/017621
§ 371 (c)(1),
(2) Date: May 22, 2023

(87) PCT Pub. No.: WO2022/114849
PCT Pub. Date: Jun. 2, 2022

(65) Prior Publication Data

US 2024/0027110 A1 Jan. 25, 2024

(30) Foreign Application Priority Data

Nov. 27, 2020 (KR) ..... 10-2020-0163010
Nov. 27, 2020 (KR) ..... 10-2020-0163011
Nov. 3, 2021 (KR) ..... 10-2021-0150027

(51) Int. Cl.
*F25B 39/00* (2006.01)
*F25B 39/04* (2006.01)

(52) U.S. Cl.
CPC ..... *F25B 39/00* (2013.01); *F25B 39/04* (2013.01); *F25B 2339/041* (2013.01)

(58) Field of Classification Search
CPC .... F25B 39/00; F25B 2339/041; F25B 39/04; F25B 2339/047; F24F 1/18; F24F 1/039;
(Continued)

(56) References Cited

U.S. PATENT DOCUMENTS 10,948,202 B2 3/2021 Lee et al.
2007/0256823 A1 11/2007 Molt et al.
(Continued)

FOREIGN PATENT DOCUMENTS

CN 109520338 A 3/2019
EP 3575723 A1 12/2019
(Continued)

OTHER PUBLICATIONS

Pdf is translation of foreign reference KR 200286535 Y1 (Year: 2002).*
(Continued)

*Primary Examiner* — Len Tran
*Assistant Examiner* — Kamran Tavakoldavani
(74) *Attorney, Agent, or Firm* — Dority & Manning, P.A.

(57) ABSTRACT

The present invention provides an evaporative condenser capable of ensuring cooling performance without generating pressure loss, and provides an evaporative condenser comprising: a condensation module; a water injection module for spraying; and a blowing module, wherein the condensation module has stacked N header rows, each comprising: a first header which is disposed at one side thereof and in which a flow path is formed; and a plurality of connecting tubes for connecting the flow paths of the first header and the second header between the first header and the second header, and, here, N is a natural number greater than or equal to 2.

18 Claims, 28 Drawing Sheets

(58) Field of Classification Search
CPC ..... F28D 1/024; F28D 1/05391; F28D 5/02; F28D 2021/0066; F28D 2021/007; F28F 9/0207; F28F 9/0214; F28F 9/0224; F28F 13/003; F28F 13/185; F28F 2245/02
See application file for complete search history.

(56) References Cited

U.S. PATENT DOCUMENTS

| | | | | |
|---|---|---|---|---|
| 2011/0186277 | A1 | 8/2011 | Hanafusa | |
| 2016/0327343 | A1 | 11/2016 | Hwang et al. | |
| 2018/0238644 | A1 | 8/2018 | Struder | |
| 2022/0196345 | A1* | 6/2022 | Nakamura | F25B 39/022 |
| 2023/0194180 | A1* | 6/2023 | Takahashi | F25B 39/04 165/176 |

FOREIGN PATENT DOCUMENTS

| | | | |
|---|---|---|---|
| JP | 2003269822 | A | 9/2003 |
| JP | 20000257989 | A | 9/2009 |
| KR | 100121948 | B1 | 11/1997 |
| KR | 100289123 | B1 | 10/2001 |
| KR | 20020034713 | A | 5/2002 |
| KR | 200286535 | Y1 * | 8/2002 |
| KR | 1020060018169 | A | 2/2006 |
| KR | 100667702 | B1 | 1/2007 |
| KR | 1020170058155 | A | 5/2017 |
| KR | 20180122201 | A | 11/2018 |
| KR | 1020190006781 | A | 1/2019 |
| KR | 1020190118598 | A | 10/2019 |

OTHER PUBLICATIONS

Extended European Search Report for corresponding Application No. 21898674.3, dated Sep. 12, 2024, 7 pages.
International Search Report for Application No. PCT/KR2021/017621, mailed on Mar. 28, 2022, 8 pages.
Korean Office Action for corresponding Application No. 10-2020-0163010, dated Apr. 24, 2024, 10 pages.

* cited by examiner

EVAPORATIVE CONDENSER AND AIR CONDITIONER INCLUDING SAME

CROSS REFERENCE TO RELATED APPLICATIONS

This application is the U.S. National Stage entry of International Application No. PCT/KR2021/017621, filed on Nov. 26, 2021, which, in turn, claims priority to Korean Patent Application No. 10-2020-0163010, filed on Nov. 27, 2020; Korean Patent Application No. 10-2020-0163011, filed on Nov. 27, 2020; and Korean Patent Application No. 10-2021-0150027, filed on Nov. 3, 2021; all of which are hereby incorporated herein by reference in their entireties for all purposes.

TECHNICAL FIELD

The present disclosure relates to an evaporative condenser having improved cooling efficiency, and an air conditioner including the same.

BACKGROUND ART

A condenser may be a heat exchanger for cooling and liquefying a high-temperature and high-pressure refrigerant steam supplied from a compressor, and may serve to release heat in a refrigeration cycle externally.

An evaporative condenser may be configured to spray water into a tube through which a cooling fluid passes in a combined water-cooling and air-cooling manner, to flow air supplied from a blower to a surface of the tube, and to discharge vaporized steam from the surface of the tube to cool the cooling fluid.

Patent Document 1 discloses an evaporative condenser.

Patent Document 1 discloses a flat tube in which a flow path of a cooling fluid is formed therein and bent in a zigzag direction, an evaporative water supply unit supplying evaporative water to the flat tube, and a blower supplying air in the opposite direction of the evaporative water.

In Patent Document 1, since the flat tube is used, a cross-section thereof from inflow of a fluid to outflow of the fluid may be constant. However, steam may be cooled and liquefied in the condenser, and even when a volume having the same magnitude flows in, the volume may decrease from the inflow toward the outflow, and loss in pressure may occur due to a decrease in volume when a cross-section is constant.

(Patent Document 1) KR 10-2019-0006781 A

SUMMARY OF INVENTION

Technical Problem

To solve the problem, the present disclosure is to provide an evaporative condenser ensuring cooling performance without generating loss in pressure, and an air conditioner including the same.

Solution to Problem

The present disclosure provides the following evaporative condenser and air conditioner to achieve the object.

In an embodiment, the present disclosure provides an evaporative condenser including a condensation module including a fluid passage; a water injection module disposed on the condensation module and spraying water passing through the condensation module; and a blowing module disposed on one side of the condensation module and providing air passing through the condensation module, wherein N header rows are stacked in the condensation module, where N is a natural number of 2 or more, wherein the N header rows include a first header disposed on the one side and having a flow path formed therein, a second header disposed on the other side and having a flow path formed therein, and a plurality of connection tubes connecting the flow path of the first header and the flow path of the second header between the first header and the second header, and the condensation module, the water injection module, and the blowing module are arranged to pass the water sprayed by the water injection module and the air provided by the blowing module between the plurality of connection tubes of the condensation module.

In an embodiment, in the condensation module, a fluid inlet may be connected to a first header row, and a fluid outlet may be connected to an Nth header row, and a direction of stacking from the first header row to the Nth header row may be opposite to a direction in which the blowing module supplies the air.

In an embodiment, in the condensation module, the fluid inlet may be connected to the first header of the first header row, and a flow path hole may be formed between the first header of the first header row and the first header of the second header row disposed above the first header row.

In an embodiment, the header row may include a 2-1 direction header row in which a fluid flows in the plurality of connection tubes in a 2-1 direction from the first header to the second header, and a 2 direction header row in which a fluid flows in the plurality of connection tubes in a 2-2 direction from the second header to the first header, wherein A header rows sequentially stacked from the first header row may be the 2-1 direction header row, and wherein the evaporative condenser may satisfy $A>M$, and $A+M\leq N$, and $A\geq 2$, where the number of 2-1 or 2-2 direction header rows continuously arranged downwardly from the Nth header row including the Nth header row is M, and A and M are natural numbers.

In an embodiment, the header rows may include a 2-1 direction header row in which a fluid flows in the plurality of connection tubes in a 2-1 direction from the first header to the second header, and a 2-2 direction header row in which a fluid flows in the plurality of connection tubes in a 2-2 direction from the second header to the first header, wherein A header rows sequentially stacked from the first header row may be the 2-1 direction header row, B header rows sequentially stacked on an Ath header row may be the 2-2 directional header row, and C header rows sequentially stacked on the Ath header row and a Bth header row may be the 2-1 directional header row, wherein the evaporative condenser may satisfy $A\geq B$, $A>C$, and $A+B+C\leq N$, where A, B, and C are natural numbers.

In an embodiment, the header rows may include a 2-1 direction header row in which a fluid flows in the plurality of connection tubes in a 2-1 direction from the first header to the second header, and a 2-2 direction header row in which a fluid flows in the plurality of connection tubes in a 2-2 direction from the second header to the first header, wherein a fluid introduced into the fluid inlet may alternately pass through the 2-1 direction header row and the 2-2 direction header row, and may be discharged to the fluid outlet, and wherein the number of header rows in the 2-1 or 2-2 direction through which the fluid passes may decrease from the fluid inlet to the fluid outlet.

In an embodiment, a fluid inlet may be connected to a first header of a first header row, and a fluid outlet may be connected to an Nth header row, wherein the plurality of connection tubes may include a 2-1 direction connection tube in which a fluid flows in a 2-1 direction from the first header to the second header, and a 2-2 direction connection tube in which a fluid flows in a 2-2 direction from the second header to the first header, wherein a fluid introduced into the fluid inlet may alternately pass through the 2-1 direction connection tube and the 2-2 direction connection tube, and may be discharged to the fluid outlet, wherein the number of connection tubes through which the fluid passes may decrease from the fluid inlet to the fluid outlet.

In an embodiment, in a header row including the 2-1 direction connection tube and the 2-2 direction connection tube, a baffle may be disposed at a corresponding position between the 2-1 direction connection tube and the 2-2 direction connection tube in the first or second header.

In an embodiment, a fluid inlet may be connected to a first header row, and a fluid outlet is connected to an Nth header row, wherein the fluid may flow from the fluid inlet to the fluid outlet in the plurality of connection tubes alternately in a 2-1 direction from the first header to the second header and in a 2-2 direction from the second header to the first header, and wherein, when flow of a fluid in the plurality of connection tubes is switched from one direction to the other direction, among the 2-1 and 2-2 directions, the condensation module may include a portion in which a sum of cross-sectional areas through which the fluid passes in the one direction is greater than a sum of cross-sectional areas through which the fluid passes in the other direction.

In an embodiment, the present disclosure provides an air conditioner including an evaporator, an expansion valve, a compressor, and a condenser, in a refrigerant cycle, wherein the condenser may be the aforementioned evaporative condenser.

In an embodiment, the air conditioner may include an indoor unit in which the evaporator is disposed; an outdoor unit in which the evaporative condenser is disposed; and a connection passage connecting the blowing module and an indoor space.

In an embodiment, the air conditioner may include a supply flow path supplying air from an outdoor space to an indoor space; a discharge flow path discharging air from the indoor space to the outdoor space; and a ventilation heat exchanger disposed on the supply flow path and the discharge flow path and configured to cross and heat-exchange between the air supplied to the indoor space and the air discharged to the outdoor space, wherein the discharge flow path may be connected to the blowing module.

In an embodiment, the air conditioner may include a supply flow path supplying air from an outdoor space to an indoor space; a discharge flow path discharging air from the indoor space to the outdoor space; and an evaporative cooler disposed on the supply flow path and including a water injection module, wherein the discharge flow path may be connected to the blowing module.

In an embodiment, the air conditioner may include a circulation flow path circulating air in an indoor space, wherein the evaporator may be disposed on a path of the circulation flow path.

In an embodiment, the air conditioner may include an outdoor unit in which the condenser is disposed; and an indoor unit in which the evaporator is disposed, wherein the outdoor unit may include an evaporative cooler disposed on an inflow flow path into which air in an outdoor space is introduced, including a dry channel and a wet channel, and cooling the air passing through the dry channel; a dehumidification rotor disposed on the inflow flow path before the evaporative cooler and dehumidifying the introduced air; and a heater disposed on a regeneration flow path through which air for regenerating the dehumidification rotor passes, before the dehumidification rotor, to heat the air, wherein the dehumidification rotor may be disposed over the regeneration flow path and the inflow flow path, and wherein the inflow flow path may pass through the evaporative cooler, and may be branched into an indoor supply flow path connected to an indoor space, a condenser supply flow path connected to the condenser, and a cooler supply flow path connected to the wet channel of the evaporative cooler, and the indoor supply flow path may be connected to the indoor unit.

In an embodiment, the air conditioner may further include a discharge flow path through which air flows out from an indoor space, wherein the discharge flow path may be connected to the regeneration flow path.

Advantageous Effects of Invention

The present disclosure may provide a three-dimensional evaporative condenser in which no loss in pressure occurs, and an air conditioner including the same.

DESCRIPTION OF REFERENCE CHARACTERS

1: Condensation Modules 10, 20, 30, 40, 50, 60, 70: Header Rows
11, 21, 31, 41, 51, 61, 71: First Headers
12, 22, 32, 42, 52, 62, 72: Second Headers
13, 23, 33, 43, 53, 63, 73: Connection Tubes
11*a*, 11*b*, 11*e*: Baffle
22*e*. 31*e*. 41*e*, 42*e*, 51*e*, 52*e*: Baffle
90: Water Injection Module 95: Blower
F: Pin Member
110: Evaporative Condenser 120: Expansion Valve
130: Evaporator 140: Compressor
150: Indoor unit 151: Blower
160; Ventilation Heat Exchanger 170: Evaporative Cooler
180: Dehumidification Rotor 185: Heater

BEST MODE FOR INVENTION

Hereinafter, specific embodiments of the present disclosure will be described with reference to the accompanying drawings.

Figure 1:
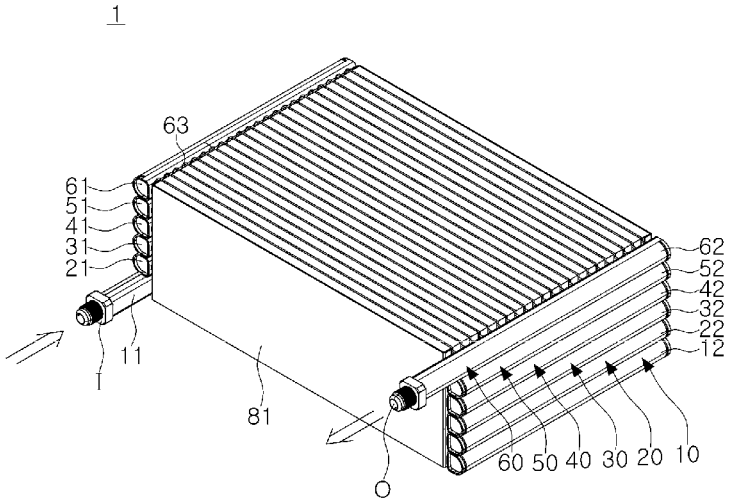
FIG. 1 is a schematic perspective view of a condensation module of an evaporative condenser according to an embodiment of the present disclosure.
Figure 2:
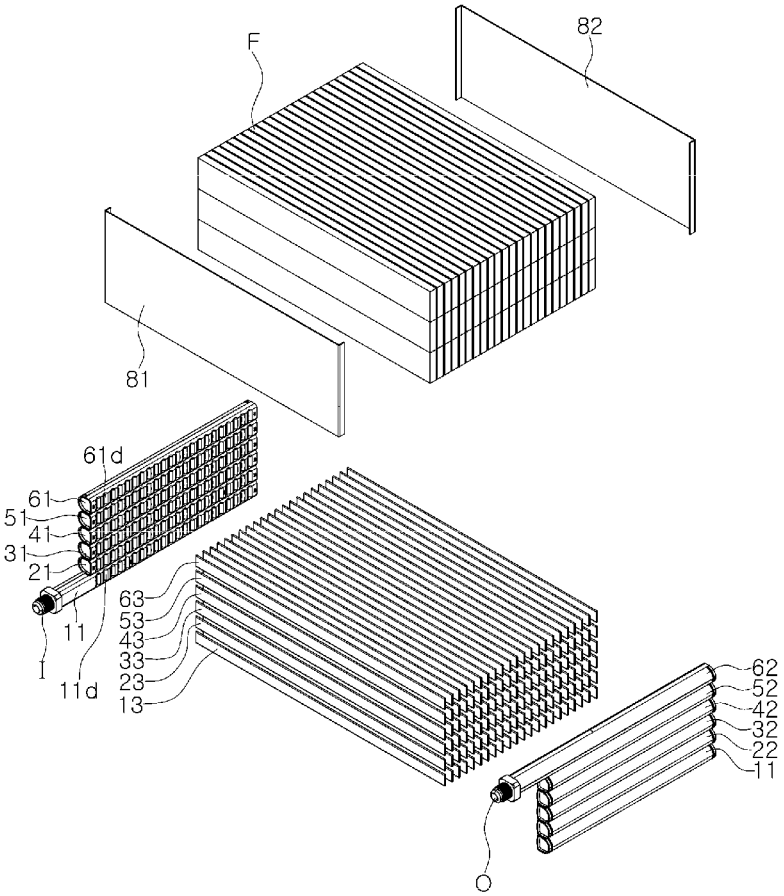
FIG. 2 is an exploded perspective view of the condensation module of FIG. 1.
Figure 3:
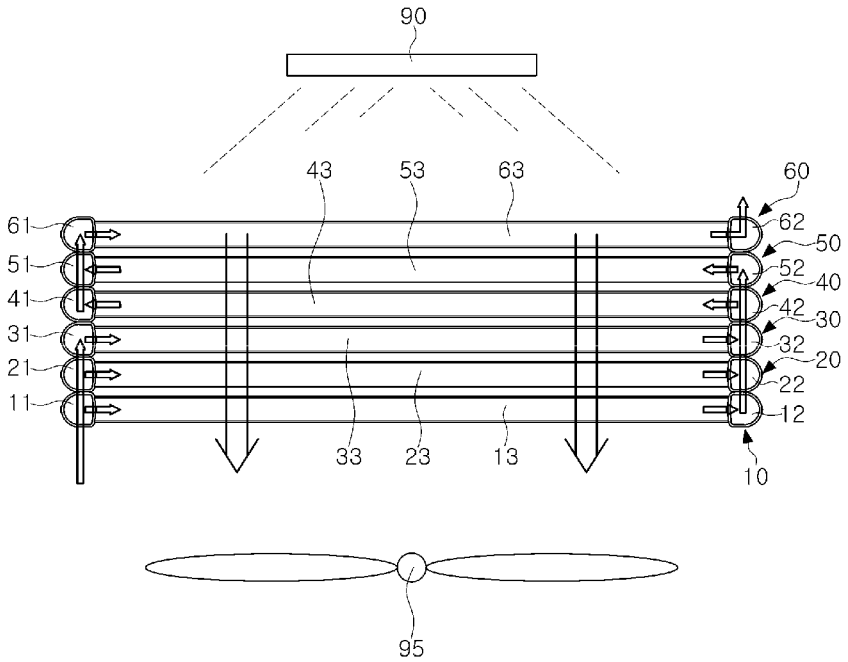
FIG. 3 is a schematic view of an evaporative condenser.
Figure 4:
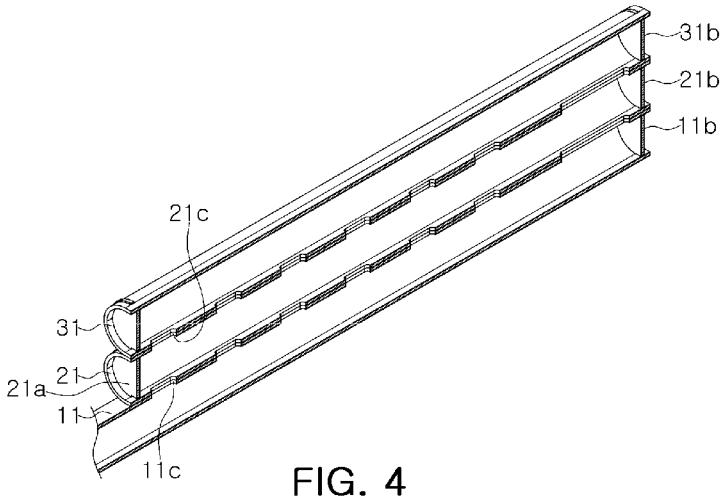
FIG. 4 is a cross-sectional perspective view of a first header of first to third header rows of the condensation module of FIG. 1.

FIGS. 1 to 4 disclose a condenser 1 according to an embodiment of the present disclosure, and an evaporative cooling device including the same. Specifically, FIG. 1 illustrates a schematic perspective view of a condenser 1 according to an embodiment of the present disclosure, FIG. 2 illustrates an exploded perspective view of the condenser 1 of FIG. 1, FIG. 3 illustrates a schematic view of an evaporative cooling device including the condenser 1 of FIG. 1, and FIG. 4 illustrates a cross-sectional perspective view of a first header (11, 21, and 31) of first to third header rows 10, 20, and 30 in the condenser 1 of FIG. 1.

As illustrated in FIGS. 1 to 3, a condenser 1 according to an embodiment of the present disclosure may include first to sixth header rows 10, 20, 30, 40, 50, and 60, a fluid inlet I may be connected to the first header row 10, a fluid outlet O may be connected to the sixth header row 60, covers 81 and 82 may be disposed on both sides of connection tubes (13, 23, 33, 43, 53, or 63) of the first to sixth header rows 10, 20, 30, 40, 50, and 60 in front and rear directions, and a fin member F assisting heat exchange may be disposed between each of the connection tubes (13, 23, 33, 43, 53, or 63).

In addition, a water injection module 90 spraying water may be disposed above the condenser 1, and a blower 95 flowing air between the connection tubes (13, 23, 33, 43, 53, or 63) may be disposed below the condenser 1.

A fluid (a refrigerant) may flow in the first header row 10, which is a lower portion of the condenser 1, and may flow out of the sixth header row 60, which is an upper portion of the condenser 1. The water may be sprayed from top to bottom through the water injection module 90. The air may may pass through the connection tubes (13, 23, 33, 43, 53, or 63), together with water, while being moved from the upper portion to the lower portion by the blower 95 disposed in the lower portion. The water may evaporate while passing between the connection tubes (13, 23, 33, 43, 53, or 63), and heat exchange may occur between the fluid and the water/air by latent heat of evaporation and sensible heat of water/air, to condense a fluid passing through the condenser 1. In this case, a heat exchange area may increase by the fin member F disposed between the connection tubes (13, 23, 33, 43, 53, or 63).

In this embodiment, the heat exchange may occur between the water/air and the fluid (the refrigerant). The heat exchange may occur by counterflow. In other words, since the heat exchange may occur as the water and the air flow from the upper portion to the lower portion and the fluid flows from the lower portion to the upper portion, it is possible to lower a temperature of a final fluid, compared to non-counterflow. In particular, as described below, cooling efficiency may be improved by a structure of this embodiment, and it is possible to maintain a size of the condenser 1 while lowering the temperature of the final fluid, by this structure and the counterflow configuration.

In this embodiment, the air was described by the blower 95 in a manner that moves from top to the lower portion, but is not limited thereto, and the blower 95 may be installed in the upper portion, to be operated in a manner that pushes the air from top to bottom.

Furthermore, it is also possible to allow flow of the air itself from bottom to top.

The condenser 1 of the present disclosure may have a three-dimensional structure because the fluid passes in a first direction, which is an extension direction of the header, in a second direction, which is an extension direction of the connection tube, and in a third direction, which is a stacking direction of the header row, and, as a result, even when the same volume is occupied, more heat exchange is possible, and cooling performance may be improved. In this case, the first direction, the second direction, and the third direction may be different directions.

For example, the first direction may be an X-direction, the second direction may be a Y-direction, perpendicular to the X-direction, and the third direction may be a Z-direction, perpendicular to the X-direction and the Y-direction. Alternatively, the first direction may be a radial direction, the second direction may be a circumferential direction, and the third direction may be a height direction.

In the present disclosure, the fluid may be introduced into the fluid inlet, may flow in along the first header (11, 21, 31, 41, 51, or 61), may pass through the connection tube (13, 23, 33, 43, 53, or 63) to reach the second header (12, 22, 32, 42, 52, or 62), may move in the third direction from the second header (12, 22, 32, 42, 52, or 62), and may pass through the connection tube (13, 23, 33, 43, 53, or 63) from the second header (12, 22, 32, 42, 52, or 62) to reach the first header (11, 21, 31, 41, 51, or 61), and all of the processes may be repeated. For example, the fluid may flow from the first header in a direction toward the second header and then from the second header in a direction toward the first header, and when the directions are changed, a cross-sectional area through which the fluid passes may be reduced. In the second direction, a direction from the first header (11, 21, 31, 41, 51, or 61) toward the second header (12, 22, 32, 42, 52, or 62) may be called a 2-1 direction, and a direction from the second header (12, 22, 32, 42, 52, or 62) toward the first header (11, 21, 31, 41, 51, or 61) may be called a 2-2 second direction.

The first to sixth head rows 10, 20, 30, 40, 50, and 60 of the present disclosure may include a first header (11, 21, 31, 41, 51, or 61) disposed on one side and having a flow path formed therein, a second header (12, 22, 32, 42, 52, or 62) disposed on the other side and having a flow path formed therein, and a plurality of connection tubes (13, 23, 33, 43, 53, or 63) connecting the flow path of the first header (11, 21, 31, 41, 51, or 61) and the flow path of the second header (12, 22, 32, 42, 52, or 62) between the first header (11, 21, 31, 41, 51, or 61) and the second header (12, 22, 32, 42, 52, or 62).

In the first header 11 of the first header row 10, in a longitudinal direction, one side may be connected to the fluid inlet I, and the other side may have a tubular shape blocked by a baffle 11*b*. A flow path hole 11*c* may be formed in an upper portion of the first header 11 of the first header row 10, and a flow path hole 21*c* may be also formed in a lower portion of the first header 21 of the second header row 10 in a position corresponding to the flow path hole 11*c* of the first header row 10. Furthermore, in the first header 21 of the second header row 20, in addition to the lower portion, the flow path hole 21*c* may be also formed in an upper portion facing the third header row 30 of the first header 31, a flow path hole 31*c* may be also formed in the first header 31 of the third header row 30 in a position corresponding to the flow path hole 21*c*, and the fluid introduced into the first header 11 of the first header row 10 may move to the first header 21 of the second header row 20 and the first header 31 of the third header row 30.

In the first header 21 of the second header row 20, both sides in the longitudinal direction may be blocked by baffles 21*a* and 21*b*, and the first header 31 of the third header row 30 may be in the same manner.

Communication holes 11*d*and 61*d* for being connected to the connection tubes (13, 23, 33, 43, 53, or 63) may be formed in a surface of the first header (11, 21, 31, 41, 51, or 61) facing the second header (12, 22, 32, 42, 52, or 62), a plurality of connecting tubes (13, 23, 33, 43, 53, or 63) may be connected between the first header (11, 21, 31, 41, 51, or 61) and the second header (12, 22, 32, 42, 52, or 62). Therefore, a plurality of communication holes 11*d* and 61*d* may be also formed.

The second header (12, 22, 32, 42, 52, or 62) may be formed symmetrically to have the same structure as the first header (11, 21, 31, 41, 51, or 61). The connection tubes (13, 23, 33, 43, 53, or 63) may have a structure in which a plurality of microchannels, that is, minute channels, are formed in a longitudinal direction of the tube. The fin member F may be connected between the connection tubes (13, 23, 33, 43, 53, or 63) to expand a heat exchange area. The connection tubes (13, 23, 33, 43, 53, or 63) and the first and second headers (11, 12, 21, 22, 31, 32, 41, 42, 51, 52, 61, or 62) may be coated with tech arc coating (TAC).

The fin member F may be coated with a hydrophilic or hydrophilicity-containing porous material to evenly spread water sprayed by the water injection module 90. The porous material may be coated with a metal organic framework (MOF).

Referring to FIG. 3, flow of a fluid in an evaporative cooling device including the condenser 1 having such a structure will be described.

In an embodiment of the present disclosure, the fluid introduced into the first header 11 in the first header row 10 may be divided into the first header 21 in the second header row 20 and the first header 31 in the third header row 30, may flow from the first header (11, 21, and 31) to the second header (12, 22, and 32) through the connection tubes (13, 23, and 33) in the first to third header rows 10, 20, and 30, and, in the meantime, may be heat-exchanged by water/air to be partially changed from gas to liquid, to reduce a volume occupied by the same weight of fluid.

The second header (12, 22, and 32) in the first to third header rows 10, 20, and 30 may be connected to the second header (42 and 52) in the fourth and fifth header rows 40 and 50 through a flow path hole, and thus the fluid introduced into the second header (12, 22, and 32) in the first to third header rows 10, 20, and 30 may rise again to the second header (42 and 52) in the fourth and fifth header rows 40 and 50. After that, the fluid may flow from the second header (42 and 52) to the first header (41 and 51) through the connection tubes (43 and 53) in the fourth and fifth header rows 40 and 50, and may be heat-exchanged by water/air while passing through the connection tubes (43 and 53) to be partially changed into liquid by gas, to reduce a volume occupied by the same weight of fluid again.

The fluid introduced into the first header (41 and 51) of the fourth and fifth header rows 40 and 50 may rise to the first header 61 of the sixth header row 60 through a flow path hole formed between the fourth to sixth header rows 40, 50, and 60. The risen fluid may move from the first header 61 to the second header 62 through the connection tube 63 in the sixth header row 60, and may be heat-exchanged with water/air and condensed into liquid while passing through the connection tube 63. The second header 62 in the sixth header row 60 may be connected to the fluid outlet O, and the fluid condensed while passing through the first to sixth header rows 10, 20, 30, 40, 50, and 60 may be discharged through the fluid outlet O, and may be sent to a configuration of another cooling cycle.

In a condenser 1 according to an embodiment of the present disclosure, a fluid may be introduced into the first header 11, may flow in the 2-1 direction from the first header (11, 21, 31, 41, 51, or 61) to the second header (12, 22, 32, 42, 52, or 62), may change a direction thereof to flow in the 2-2 direction from the second header (12, 22, 32, 42, 52, or 62) to the first header (11, 21, 31, 41, 51, or 61), may change a direction thereof again to flow in the 2-1 direction from the first header (11, 21, 31, 41, 51, or 61) to the second header (12, 22, 32, 42, 52, or 62), and may be discharged through the fluid outlet O. When the 2-1 direction→the 2-2 direction→the 2-1 direction are proceeded, the number of header rows to be passed may be changed. For example, after introducing the fluid, the number of header rows flowing in the 2-1 direction may be three (3) as the first to third header rows 10, 20, and 30. After changing a direction thereof to flow in the 2-2 direction, the number of header rows may be reduced to be two (2) as the fourth and fifth header rows 40 and 50. After changing a direction thereof again to flow in the 2-1 direction, the number of header rows may be reduced to be one (1) as the sixth header row 60. The number of header rows passing through as a whole changes may be reduced as 3→2→1.

In an embodiment of the present disclosure, since the header rows may be stacked in the same size, a large number of header rows means a large area through which the fluid passes, which is referred to as occupying a large volume, and a small number of header rows means a small area through which the fluid passes, which is referred to as occupying a small volume.

Therefore, around the fluid inlet I, in which most of the fluid is provided in a gaseous state initially, the fluid passing in the 2-1 direction may be cooled while simultaneously passing through three (3) header rows, e.g., the connection tubes (13, 23, and 33) of the first to third header rows 10, 20, and 30. As heat exchange occurs in a backward direction to increase a liquid state thereof, the fluid may pass through a smaller number of header rows, and may finally pass only the connection tube 63 of the header row 60. Therefore, a cross-sectional area of the flow path of the condenser 1 passing through according to a reduction in volume of the fluid may be reduced, and loss in pressure to be generated may be reduced by the reduction in volume.

The reduction of loss in pressure means that a lot of heat exchange is performed during a time period through which fluid (refrigerant) passes, and a large amount of heat exchange is possible even when the condenser has the same size. Therefore, the condenser may be used in a small size with the same capacity, and large capacity cooling is possible with the same size.

In addition, the condenser 1 of the present disclosure may have a three-dimensional structure because the fluid passes in a first direction, which is an extension direction of the header, in a second direction, which is an extension direction of the connection tube, and in a third direction, which is a stacking direction of the header row, and, as a result, even when the same volume is occupied, more heat exchange is possible, and cooling performance may be improved. In this case, the first direction, the second direction, and the third direction may be different directions. For example, the first direction may be an X-direction, the second direction may be a Y-direction, perpendicular to the X-direction, and the third direction may be a Z-direction, perpendicular to the X-direction and the Y-direction.

FIGS. 5A to 5D illustrate schematic views of a condenser according to another embodiment of the present disclosure.

Embodiments of FIGS. 5A to 5D may be identical to each other in view of the facts that a fluid is introduced into a first header 11 of a first header row 10, but may be different from each other in view of the total number of header rows 10, 20, 30, 40, 50, and 60 and the number of header rows passing in 2-1 and 2-2 directions.

Figure 5A:
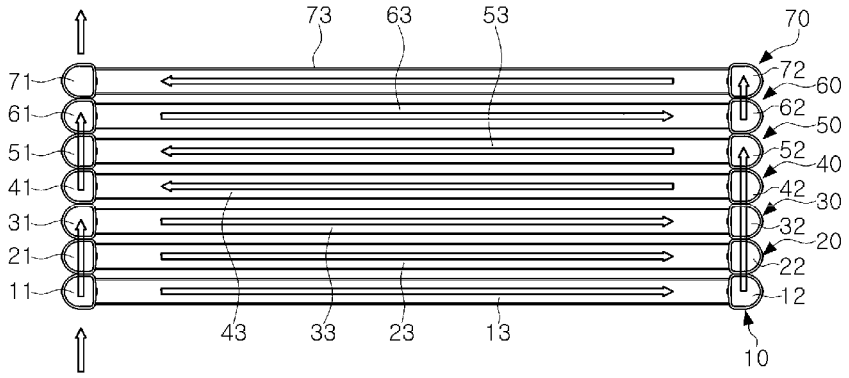
FIGS. 5A to 5D are schematic views of a condensation module according to another embodiment of the present disclosure.

In an embodiment of FIG. 5A, a fluid introduced into a first header 11 in a first header row 10 may be divided into a first header 21 in a second header row 20 and a first header 31 in a third header row 30, and may flow from a first header (11, 21, and 31) to a second header (12, 22, and 32) through connection tubes (13, 23, and 33) in first to third header rows 10, 20, and 30, and, in the meantime, may be heat-exchanged by water/air to be partially changed from gas to liquid, to reduce a volume occupied by the same weight of fluid.

The second header (12, 22, and 32) in the first to third header rows 10, 20, and 30 may be connected to the second header (42 and 52) in the fourth and fifth header rows 40 and 50 through a flow path hole, and thus the fluid introduced into the second header (12, 22, and 32) in the first to third header rows 10, 20, and 30 may rise again to the second header (42 and 52) in the fourth and fifth header rows 40 and 50. After that, the fluid may flow from the second header (42 and 52) to the first header (41 and 51) through the connection tubes (43 and 53) in the fourth and fifth header rows 40 and 50, and may be heat-exchanged by water/air while passing through the connection tubes (43 and 53) to be partially changed into liquid by gas, to reduce a volume occupied by the same weight of fluid again.

The fluid introduced into the first header (41 and 51) in the fourth and fifth header rows 40 and 50 may rise to the first header 61 in the sixth header row 60 through a flow path hole formed between the fourth to sixth header rows 40, 50, and 60. The risen fluid may move from the first header 61 to the second header 62 through the connection tube 63 in the sixth header row 60, and may be heat-exchanged with water/air and condensed into liquid while passing through the connection tube 63. The second header 62 in the sixth header row 60 may be configured to communicate with the second header 72 in the seventh header row 70, such that the fluid entering the second header 62 in the sixth header row 60 may rise to the second header 72 in the seventh header row 70, may pass through the connection tube 73 and the first header 71 in the seventh header row 70, may be discharged through a fluid outlet O, and may be sent to a configuration of another cooling cycle.

In this embodiment, the fluid supplied to the condenser 1 may change a direction thereof to pass through the header rows 10, 20, 30, 40, 50, 60, and 70 in the 2-1 direction→the 2-2 direction→the 2-1 direction→the 2-2 direction, and the number of header rows may decrease from an initial stage thereof in a backward direction. For example, as the fluid passes through the header rows 10, 20, 30, 40, 60, and 70 of the condenser 1, the number of header rows may decrease in the 2-1 direction→2-2 direction→the 2-2 direction→2-2 direction, to have 3→2→1→1. In this case, when a direction change occurs a plurality of times, the number of header rows does not necessarily have to be reduced during all direction changes, and as necessary, the number of header rows may be maintained without being reduced during some direction changes. For example, it is also possible to keep a cross-sectional area through which the fluid passes after sufficiently converting into a liquid.

Figure 5B:
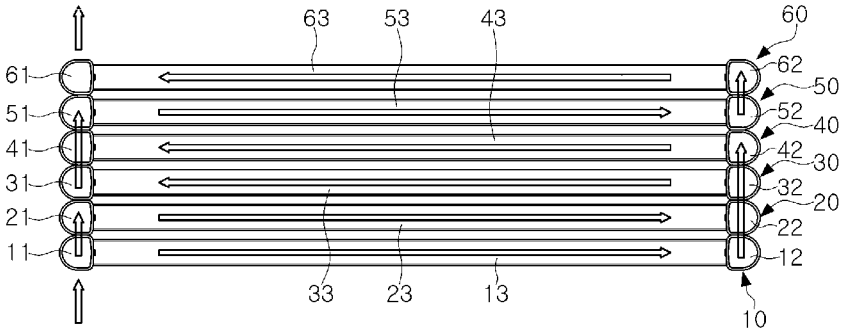

In an embodiment of FIG. 5B, a fluid introduced into a first header 11 in a first header row 10 may be divided into a first header 21 in a second header row 20, may flow from the first header (11 and 21) to the second header (12 and 22) in first and second header rows 10 and 20, and, in the meantime, may be heat-exchanged by water/air to be partially changed from gas to liquid, to reduce a volume occupied by the same weight of fluid.

The second header (12 and 22) in the first to second header rows 10 and 20 may be connected to the second header (32 and 42) in the third and fourth header rows 30 and 40 through a flow path hole, and thus the fluid introduced into the second header (12 and 22) in the first to second header rows 10 and 20 may rise again to the second header (32 and 42) in the third and fourth header rows 30. After that, the fluid may flow from the second header (32 and 42) to the first header (31 and 41) through the connection tubes (33 and 43) in the third and fourth header rows 30 and 40, and may be heat-exchanged by water/air while passing through the connection tubes (33 and 43) to be partially changed into liquid by gas.

The fluid introduced into the first header (31 and 41) in the third and fourth header rows 30 and 40 may rise to the first header 51 of the fifth header row 50 through a flow path hole formed between the third to fifth header rows 30, 40, and 50. The risen fluid may move from the first header 51 to the second header 52 through the connection tube 53 in the fifth header row 50, and may be heat-exchanged with water/air and condensed into liquid while passing through the connection tube 53. The second header 52 in the fifth header row 50 may be configured to communicate with the second header 62 in the sixth header row 60, such that the fluid entering the second header 52 in the fifth header row 50 may rise to the second header 62 in the sixth header row 60, may pass through the connection tube 63 and the first header 61 in the sixth header row 60, may be discharged through a fluid outlet O, and may be sent to a configuration of another cooling cycle.

In this embodiment, the fluid supplied to the condenser 1 may change a direction thereof to pass through the header rows 10, 20, 30, 40, 50, and 60 in the 2-1 direction→the 2-2 direction→the 2-1 direction→the 2-2 direction, and the number of header rows in an initial stage thereof may be larger than the number of header rows that finally pass. For example, as the fluid passes through the header rows 10, 20, 30, 40, 50, and 60 of the condenser 1, the number of header rows may be in the 2-1 direction→2-2 direction→the 2-1 direction→2-2 direction, to have 2→2→1→1. In this manner, it is also possible to reduce a cross-sectional area in only one portion.

Figure 5C:
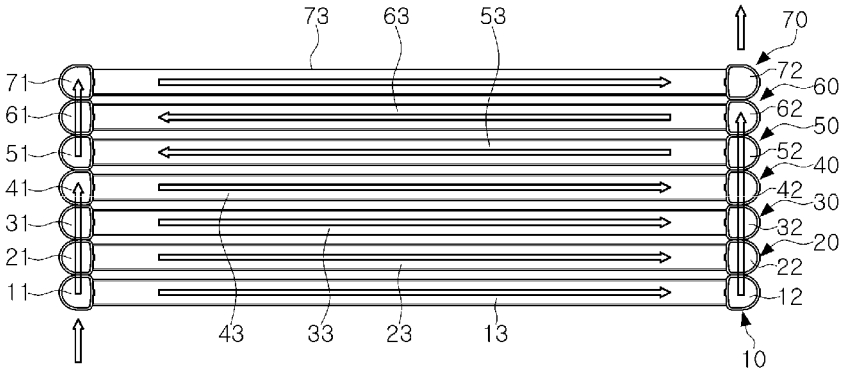

In an embodiment of FIG. 5C, a fluid introduced into a first header 11 in a first header row 10 may be divided into a first header (21, 31, and 41) in second to fourth header 20, 30, and 40, and may flow from a first header (11, 21, 31, and 41) to a second header (12, 22, 32, and 42) through connection tubes (13, 23, 33, and 43) in first to fourth header rows 10, 20, 30, and 40, and, in the meantime, may be heat-exchanged by water/air to be partially changed from gas to liquid, to reduce a volume occupied by the same weight of fluid The second header (12, 22, 32, and 42) in the first to fourth header rows 10, 20, 30, and 40 may be connected to the second header (52 and 62) in the fifth and sixth header rows 50 and 60 through a flow path hole, and thus the fluid introduced into the second header (12, 22, 32, and 42) in the first to fourth header rows 10, 20, 30, and 40 may rise again to the second header (52 and 62) in the fifth and sixth header rows 50 and 60. After that, the fluid may flow from the second header (52 and 62) to the first header (51 and 61) through the connection tubes (53 and 63) in the fifth and sixth header rows 50 and 60, and may be heat-exchanged by water/air while passing through the connection tubes (53 and 63) to be partially changed into liquid by gas.

The fluid introduced into the first header (51 and 61) in the fifth and sixth header rows 50 and 60 may rise to the first header 71 in the seventh header row 70 through a flow path hole formed between the fifth to seventh header rows 50, 60, and 70. The risen fluid may move from the first header 71 to the second header 72 through the connection tube 73 in the seventh header row 77, and may be heat-exchanged with water/air and condensed into liquid while passing through the connection tube 73. After that, the fluid may pass through the second header 72 in the seventh header row (70), may be discharged through a fluid outlet O, and may be sent to a configuration of another cooling cycle.

In this embodiment, the fluid supplied to the condenser 1 may change a direction thereof to pass through the header rows 10, 20, 30, 40, 50, 60, and 70 in the 2-1 direction→the 2-2 direction→the 2-1 direction, and the number of header rows may decrease in a backward direction. For example, as the fluid passes through the header rows 10, 20, 30, 40, 50, 60, and 70 of the condenser 1, the number of header rows may decrease in the 2-1 direction→the 2-2 direction→the 2-1 direction, to have 4→2→1.

Figure 5D:
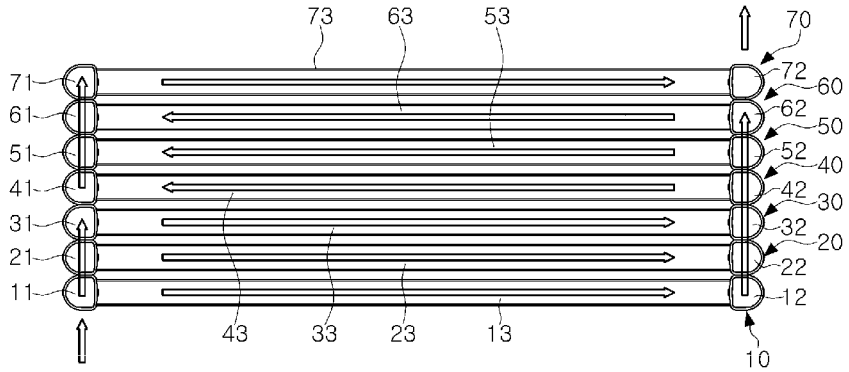

In an embodiment of FIG. 5D, a fluid introduced into a first header 11 in a first header row 10 may be divided into a first header (21 and 31) in second and third header rows 20 and 30, and may flow from a first header (11, 21, and 31) to a second header (12, 22, and 32) through connection tubes (13, 23, and 33) in first to third header rows 10, 20, and 30.

The second header (12, 22, and 32) in the first to third header rows 10, 20, and 30 may be connected to the second header (42, 52, and 62) of the fourth to sixth header rows 40, 50, and 60 through a flow path hole, and thus the fluid introduced into the second header (12, 22, and 32) in the first to third header rows 10, 20, and 30 may rise again to the second header (42, 52, and 62) in the fourth to sixth header rows 40, 50, and 60. After that, the fluid may flow from the second header (42, 52, and 62) to the first header (41, 51, and 61) through the connection tubes (43, 53, and 63) in the fourth to sixth header rows 40, 50, and 60, and may be heat-exchanged by water/air while passing through the connection tubes (43, 53, and 63) to be partially changed into liquid by gas.

The fluid introduced into the first header (41, 51, and 61) in the fourth to sixth header rows 40, 50, and 60 may rise to the first header 71 in the seventh header row 70 through a flow path hole formed between the fourth to seventh header rows 40, 50, 60, and 70. The risen fluid may move from the first header 71 to the second header 72 through the connection tube 73 in the seventh header row 70, and may be heat-exchanged with water/air and condensed into liquid while passing through the connection tube 73. After that, the fluid may pass through the second header 72 in the seventh header row 70, may be discharged through a fluid outlet O, and may be sent to a configuration of another cooling cycle.

In this embodiment, the fluid supplied to the condenser 1 may change a direction thereof to pass through the header rows 10, 20, 30, 40, 50, 60, and 70 in the 2-1 direction→the 2-2 direction→the 2-1 direction, and the number of header rows may decrease in a backward direction. For example, as the fluid passes through the header rows 10, 20, 30, 40, 50, 60, and 70 of the condenser 1, the number of header rows may decrease in the 2-1 direction→2-2 direction→the first direction, to have 3→3→1. For example, it is also possible in the present disclosure that the number of header rows decreases only at the end.

Figure 6A:
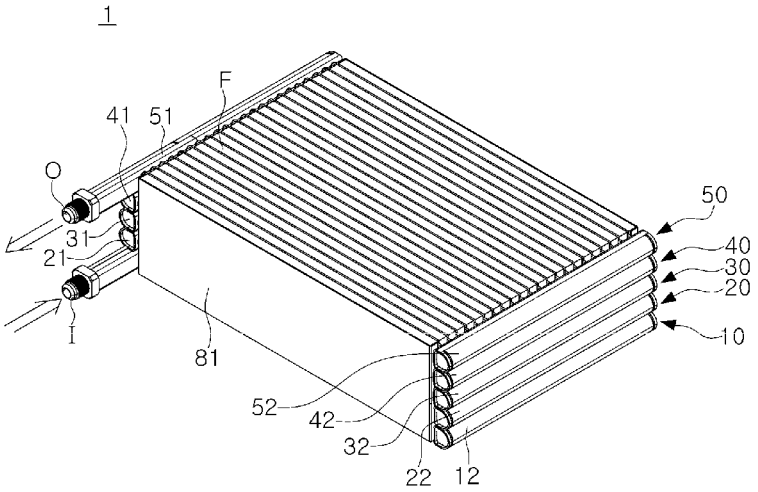
FIG. 6A is a schematic perspective view of a condensation module according to another embodiment of the present disclosure.
Figure 6B:
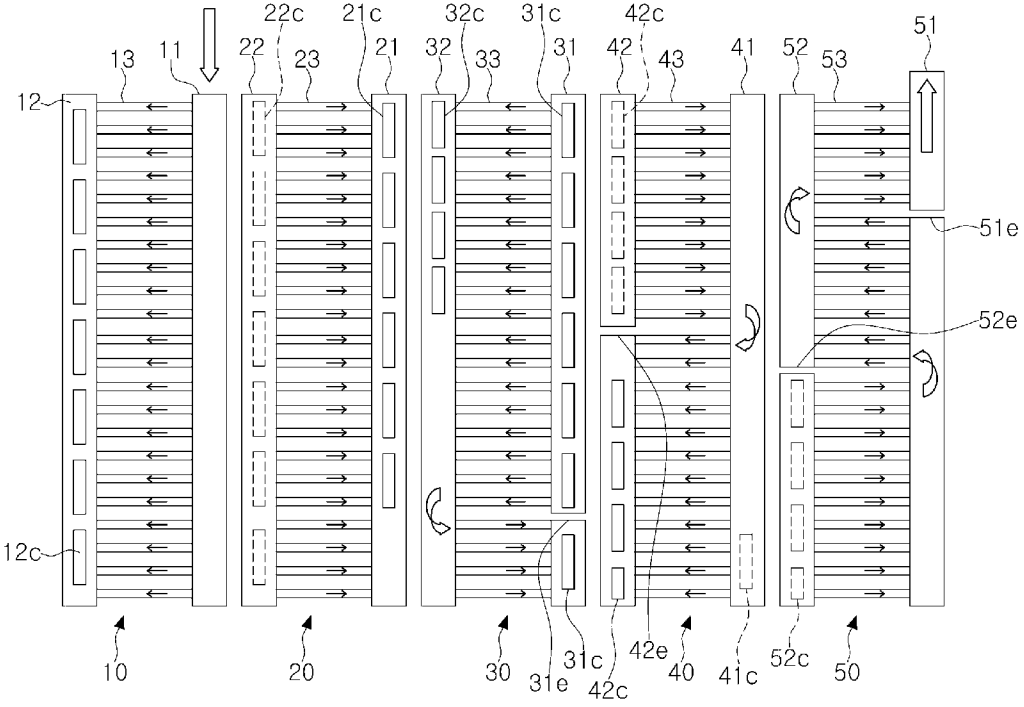
FIG. 6B is a schematic plan view of each header row of the condensation module of FIG. 6A.

FIGS. 6A and 6B illustrate a condenser of another embodiment of the present disclosure. FIG. 6A illustrates a perspective view of a condenser 1 of another embodiment of the present disclosure, and FIG. 6B may be a partial cross-sectional view of each header row (10, 20, 30, 40, and 50) of the condenser 1 of FIG. 6A.

A condenser 1 of FIGS. 6A and 6B may be identical to the condenser 1 of FIGS. 1 to 4, in view of the facts that a cross-sectional area of a flow path decreases as a fluid passes. In FIGS. 1 to 4, the cross-sectional area of the flow path to be passed may be controlled by adjusting the number of header rows 10, 20, 30, 40, 50, and 60, and in FIGS. 6A and 6B, the cross-sectional area of the flow path through which the fluid passes may be reduced by adjusting the number of connection tubes (13, 23, 33, 43, and 53).

Although illustrated in FIGS. 6A and 6B, a basic structure may be identical to that of FIGS. 1 to 4. For example, a fluid inlet I may be connected to a first header row 10, which is located on the lowermost position, and a fluid outlet O may be connected to a fifth header row 50, which is located on the uppermost position. Second to fifth header rows 20, 30, 40, and 50 may be stacked on the first header row 10, and each of the header rows 10, 20, 30, 40, and 50 may include a first header (11, 21, 31, 41, and 51) disposed on one side thereof and having a flow path formed therein, a second header (12, 22, 32, 42, and 52) disposed on the other side thereof and having a flow path formed therein, and a plurality of connection tubes (13, 23, 33, 43, and 53) connecting the flow path of the first header and the flow path of the second header between the first header (11, 21, 31, 41, and 51) and the second header (12, 22, 32, 42, and 52). As illustrated in FIG. 6B, each of the header rows 10, 20, 30, 40, and 50 may include the same number of connection tubes (13, 23, 33, 43, and 53).

The first to fifth header rows 10, 20, 30, 40, and 50 may include a 2-1 direction connection tube in which a fluid flows in a 2-1 direction from the first header (11, 21, 31, 41, and 51) to the second header (12, 22, 32, 42, and 52), and a 2-2 direction connection tube in which a fluid flows in a 2-2 direction from the second header (12, 22, 32, 42, and 52) to the first header (11, 21, 31, 41, and 51), wherein the fluid may pass through the connection tubes (13, 23, 33, 43, and 53), but may alternately pass through the 2-1 direction connection tube and the 2-2 direction connection tube.

The fluid inlet I may be connected to the first header 11 in the first header row 10, and a fluid introduced through the fluid inlet I may pass through the first header 11 and the connection tube 13, and may flow to the second header 12. Flow path holes 12*c* and 22*c* may be formed between the second header (12 and 22) in the first header row 10 and the second header row 20, and the fluid of the second header 12 in the first header row 10 may rise to the second header 22 in the second header row 20 through the flow path holes 12*c* and 22*c*. The fluid introduced into the second header 22 in the second header row 20 may pass through the connection tube 23, and may flow to the first header 21. The connection tube 13 in the first header row 10 may be the 2-1 direction connection tube through which fluid flows from the first header 11 to the second header 12, and the connection tube 23 in the second header row 20 may be the 2-2 direction connection tube through which fluid flows from the second header 22 to the first header 21.

The fluid introduced into the first header 21 in the second header row 20 may rise to the first header 31 in the third header row 30 through flow path holes 21*c* and 31*c* between the first header (21 and 31) in the second and third header rows 20 and 30. In this case, the first header 31 in the third header row 30 may have a baffle 31*e* arranged in an intermediate position thereof, and the flow path holes 21*c* and 31*c* may be divided by the baffle 31*e*, and may be formed only in a first region close to the fluid inlet. The fluid risen to the first region divided by the baffle 31*e* of the first header 31 in the third header row 30 may pass through the connection tube 33 through which the fluid flows in the 2-1 direction, and may flow to the second header 32.

In the second header 32, a portion of the fluid may rise through flow path holes 32*c* and 42*c* formed between the second header (32 and 42) in the third and fourth header rows 30 and 40, and a different portion of the fluid may flow to a second region of the first header 31 divided by the baffle 31*e* through the connection tube 33 flowing the fluid in the 2-2 direction. The flow path holes 32*c* and 42*c* in the third and fourth header rows 30 and 40 may not be formed in all length directions of the second header (32 and 42), but may be formed only in a portion corresponding to the first region divided into a baffle 42*e* in the second header 42 in the fourth header row 40. The fluid risen to the first region of the second header 42 in the fourth header row 40 may be provided in a corresponding position, and may flow to the first header 41 through the connection tube 43 in which the fluid flows in the 2-2 direction.

The fluid introduced into the second region of the first header 31 in the third header row 30 may rise to the first header 41 in the fourth header 40 through flow path holes 31*c* and 41*c* formed between the first header (31 and 41) in the third and fourth header rows 30 and 40. The fluid risen to the first header 41 in the fourth header row 40 may pass through the second header 42 and the connection tube 43 in the fourth header row 40, and may merge with a portion of the fluid introduced into the first header 41.

The merged fluid may flow to the second region of the second header 42 in the fourth header row 40, through the connection tube 43 provided in a position corresponding to a different region divided by the baffle 42*e*, e.g., the second region, and in which the fluid flows in the 2-1 direction. The fluid in the second region of the second header 42 may rise to the second header 52 in the fifth header row 50 through flow path holes 42*c* and 52*c* formed between the second header 42 in the fourth header row 40 and the second header 52 in the fifth header row 50. The flow path holes 42*c* and 52*c* may be formed only in a position corresponding to the second region (in a downward direction in FIG. 6B) far away from the fluid inlet in a plane, among regions partitioned by the baffle 52*e* in the second header 52 in the second header row 50. Therefore, the fluid may be introduced into the second region of the second header 52 in the fifth header row 50.

The fluid introduced into the second header 52 may pass through the connection tube 53 through which the fluid flows in the 2-2 direction, and may flow to the first header 51. The first header 51 may be also partitioned by a baffle 51*e*, and the fluid may flow to the second region of the first header 51 corresponding to the second region of the second header 52. As illustrated in FIG. 6B, the second region of the first header 51 may be formed to be longer than the second region of the second header 52, and thus a portion of the second region of the first header 51 may overlap the first region of the second header 52. The fluid introduced into the second region of the first header 51 may flow again to the first region of the second header 52 through the connection passage 53 connecting the overlapped section and flowing in the 2-1 direction. The fluid introduced into the first region of the second header 52 may flow again to the first header 51 through the connection tube 53 connected to the first region of the first header 51, and the fluid introduced into the first region of the first header 51 may be discharged to an outside of the condenser.

As can be seen in FIG. 6B, the introduced fluid may be heat-exchanged while passing through the headers and the connection tubes. The fluid may alternately pass through the connection tubes (13, 23, 33, 43, and 53) between the first header (11, 21, 31, 41, and 52) and the second header (12, 22, 32, 42, and 52) in the 2-1 direction (from the first header to the second header) and in the 2-2 direction (from the second header to the first header). The number of connection tubes (13, 23, 33, 43, and 53) to be passed may decrease as the fluid flows from the fluid inlet I to the fluid outlet O. In this embodiment, twenty two (22) connection tubes (13, 23, 33, 43, and 53) may be disposed in each header row, and twenty two (22) connection tubes (13) may flow in the first header row 10 in the 2-1 direction, and twenty two (22) connection tubes (23) may then flow in the second header row 20 in the 2-2 direction. In the third header row 30, the fluid may pass through eighteen (18) connection tubes (33) connected to the first region of the first header 31 in the 2-1 direction.

The fluid in a portion of the second header 32 in the third header row 30 may rise to the second header 42 in the fourth header row 40, and may flow to the first header 41 through ten (10) connection tubes (43) in the 2-2 direction. A remaining branched portion of the fluid may pass through four (4) 2-2 direction connection tubes 33 returning to the second region of the first header 31, may pass through the second region of the first header 31, may rise to the first header 41 in the fourth header row 40, and may merge with a branched portion of the fluid again. For example, the branched portion of the fluid may pass through ten (10)+four (4) connection tubes flowing in the 2-2 directions.

The merged fluid may pass through twelve (12) connection tubes 43 connected to the second region of the second header 42 in the fourth header row 40 and flowing in the first direction, may flow to the second region, and may then rise to the second region of the second header 52 in the fifth header row 50. Since the second region of the second header 52 may be connected to ten (10) connection tubes (53) flowing in the second direction, the fluid may flow through ten (10) connection tubes (53) to the second region of the first header 51.

The fluid introduced into the second region of the first header 51 may flow in seven (7) 2-1 directions, and may flow to the second header 52 through the connection tube (53) connected to the first region of the second header 52. This fluid may flow in five (5) 2-2 directions, may return to the first header 51 through the connection tube (53) connected to the first region of the first header 51, and may be then discharged through the fluid outlet O.

On the fluid path, the fluid may alternately pass through the connection tubes in the 2-1 and 2-2 directions, and the number thereof may decrease in a backward direction, to have 22→22→18→14→12→10→7→5. For example, according to an increase in density of the fluid, which had a small density around the fluid inlet, due to heat exchange, cooling efficiency may be improved by reducing the number of connection tubes (13, 23, 33, 43, and 53) to proportionally reduce a cross-sectional area, to allow appropriate cooling to be performed in a section in which a phase of the fluid is changed. In particular, since the cross-sectional area of the flow path may be adjusted according to an order in which the fluid passes through a plurality of connection tubes (13, 23, 33, 43, and 53) between the first header (11, 21, 31, 41, and 51) and the second header (12, 22, 32, 42, and 52) and the baffles (31*e*, 42*e*, 51*e*, and 52*e*) in the headers, efficient heat exchange may be achieved, depending on a refrigerant.

Figure 7A:
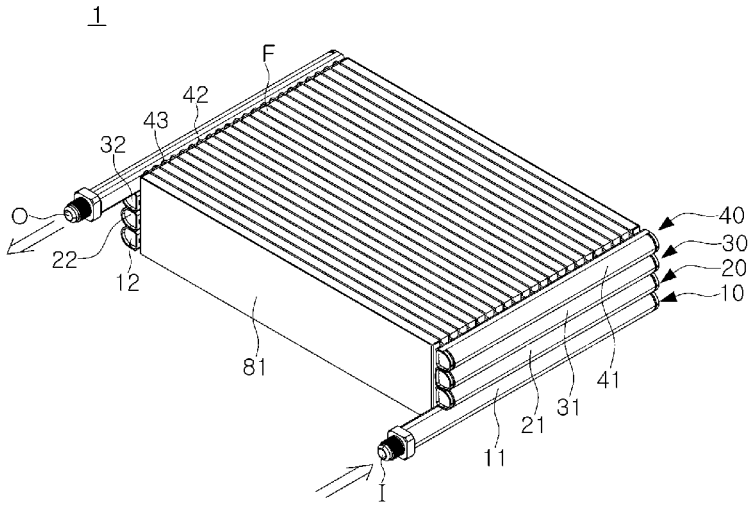
FIG. 7A is a schematic perspective view of a condensation module according to another embodiment of the present disclosure.
Figure 7B:
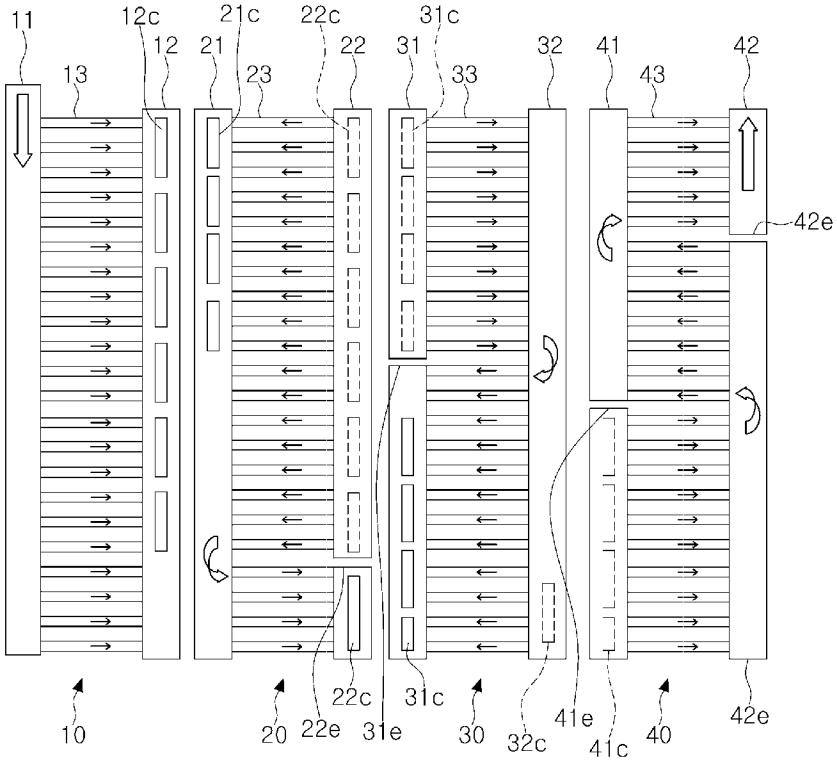
FIG. 7B is a schematic plan view of each header row of the condensation module of FIG. 7A.

FIGS. 7A and 7B illustrate a condenser of another embodiment of the present disclosure. FIG. 7A illustrates a perspective view of a condenser 1 in another embodiment of the present disclosure, and FIG. 7B illustrates a partial cross-sectional view of each header row (10, 20, 30, and 40) of the condenser 1 in FIG. 7A.

Although illustrated in FIGS. 7A and 7B, a basic structure may be identical to that of FIGS. 6A and 6B. For example, a fluid inlet I may be connected to a first header row 10, which is located on the lowermost position, and a fluid outlet O may be connected to a fourth header row 40, which is located on the uppermost position. Second to fourth header rows 20, 30, and 40 may be stacked on the first header row 10, and each of the header rows 10, 20, 30, and 40 may include a first header (11, 21, 31, and 41) disposed on one side thereof and having a flow path formed therein, a second header (12, 22, 32, and 42) disposed on the other side thereof and having a flow path formed therein, and a plurality of connection tubes (13, 23, 33, and 43) connecting the flow path of the first header and the flow path of the second header between the first header (11, 21, 31, and 41) and the second header (12, 22, 32, and 42). As illustrated in FIG. 7B, each of the header rows 10, 20, 30, and 40 may include the same number of connection tubes (13, 23, 33, and 43).

The first to fourth header rows (10, 20, 30, and 40) may include a 2-1 direction connection tube in which a fluid flows in a 2-1 direction from the first header (11, 21, 31, and 41) to the second header (12, 22, 32, and 42), and a 2-2 direction connection tube in which a fluid flows in a 2-2 direction from the second header (12, 22, 32, and 42) to the first header (11, 21, 31, and 41), wherein the fluid may pass through the connection tubes (13, 23, 33, and 43), but may alternately pass through the 2-1 direction connection tube and the 2-2 direction connection tube.

The fluid inlet I may be connected to the first header 11 in the first header row 10, and a fluid introduced through the fluid inlet I may pass through the first header 11 and the connection tube 13, and may flow to the second header 12. Flow path holes 12*c* and 22*c* may be formed between the second header (12 and 22) in the first header row 10 and the second header row 20, and the fluid of the second header 12 in the first header row 10 may rise to the second header 22 in the second header row 20 through the flow path holes 12*c* and 22*c*. In this case, the second header 22 in the second header row 20 may have a baffle 22*e* arranged in an intermediate position thereof, and the flow path holes 12*c* and 22*c* may be divided by the baffle 22*e*, may be formed only in a first region close to the fluid inlet, and, in a second region, which is a different space, flow path holes 22*c* and 32*c* may be formed between the second header (22 and 32) in the second header row 20 and the third header row 30. The fluid risen to a second region, divided by a baffle 21*e* of the first header 21 in the second header row 20 may pass through the connection tube 23 through which the fluid flows in the 2-2 direction, and may flow to the first header 21.

In the first header 21, a portion of the fluid may rise through flow path holes 21*c* and 31*c* formed between the first header (21 and 31) in the second and third header rows 20 and 30, and a different portion of the fluid may flow to the second region of the second header 22 divided by the baffle 22*e* through the connection tube 23 flowing the fluid in the 2-2 direction. The flow path holes 21*c* and 31*c* in the second and third header rows 20 and 30 may not be formed all in a length direction of the first header (21 and 31), but may be formed only in a portion corresponding to the first region divided by the baffle 31*e* in the first header 31 in the third header row 30. The fluid risen to the first region of the first header 31 in the third header row 30 may be located in the corresponding position, and may flow to the second header 32 through the connection tube 33 in which the fluid flows in the 2-1 direction.

The fluid introduced into the second region of the second header 22 in the second header row 20 may rise to the second header 32 in the third header row 30 through the flow path holes 22*c* and 32*c* formed between the second header 22 and 32 in the second and third header rows 20. The fluid risen to the second header 32 in the third header row 30 may pass through the first header 31 and the connection tube 33 in the third header row 30, and may merge with a portion of the fluid introduced into the second header 32.

The merged fluid may flow to the second region of the first header 31 in the third header row 30, through the connection tube 33 provided in a position corresponding to a different region divided by the baffle 32*e*, e.g., the second region, and in which the fluid flows in the 2-2 direction. The fluid in the second region of the first header 31 may rise to the first header 41 in the fourth header row 40 through flow path holes 31*c* and 41*c* formed between the first header 31 in the third header row 30 and the first header 41 in the fourth header row 40. The flow path holes 31*c* and 41*c* may be formed only in a position corresponding to the second region (in a downward direction in FIG. 7B) far away from the fluid inlet in a plane, among regions partitioned by the baffle 42*e* in the first header 41 in the fourth header row 40. Therefore, the fluid may be introduced into the second region of the first header 41 in the fourth header row 40.

The fluid introduced into the first header 41 may pass through the connection tube 43 through which the fluid flows in the 2-1 direction, and may flow to the second header 42. The second header 42 may be also partitioned by a baffle 42*e*, and the fluid may flow to the second region of the second header 42 corresponding to the second region of the first header 41. As illustrated in FIG. 7B, the second region of the second header 42 may be formed to be longer than the second region of the first header 41, and thus a portion of the second region of the second header 42 may overlap the first region of the first header 41. The fluid introduced into the second region of the second header 42 may flow again to the first region of the first header 41 through the connection passage 43 connecting the overlapped section and flowing in the 2-2 direction. The fluid introduced into the first region of the first header 41 may flow again to the second header 42 through the connection tube 43 connected to the first region of the second header 42, and the fluid introduced into the first region of the second header 42 may be discharged to an outside of the condenser.

As can be seen in FIG. 7B, the introduced fluid may be heat-exchanged while passing through the headers and the connection tubes. The fluid may alternately pass through the connection tubes (13, 23, 33, and 43) between the first header (11, 21, 31, and 41) and the second header (12, 22, 32, and 42) in the 2-1 direction and in the 2-2 direction. The number of connection tubes (13, 23, 33, and 43) to be passed may decrease as the fluid flows from the fluid inlet I to the fluid outlet O. In this embodiment, twenty two (22) connection tubes (13, 23, 33, and 43) may be disposed in each header row, and twenty two (22) connection tubes (13) may flow in the first header row 10 in the 2-1 direction, and eighteen (18) connection tubes (23) connected to the first region of the second header 22 in the 2-1 direction may then flow in the second header row 20 in the 2-2 direction.

The fluid in a portion of the first header 21 of the second header row 20 may rise to the first header 31 of the third header row 30, and may flow to the second header (32) through ten (10) connection tubes (33) in the 2-1 direction. A remaining branched portion of the fluid may pass through four (4) 2-1 connection tubes (23) returning to the second region of the second header 22, may pass through the second region of the second header 22, may rise to the second header 32 in the third header row 30, and may merge with a branched portion of the fluid again. For example, the branched portion of the fluid may pass through ten (10)+four (4) connection tubes flowing in the 2-1 directions.

The merged fluid may pass through twelve (12) connection tubes 33 connected to the second region of the first header 31 in the third header row 30 and flowing in the 2-2 direction, may flow to the second region, and may then rise to the second region of the first header 41 in the fourth header row 40. Since the second region of the first header 41 may be connected to ten (10) connection tubes (43) flowing in the 2-1 direction, the fluid may flow through ten (10) connection tubes (43) to the second region of the second header 42.

The fluid introduced into the second region of the second header 42 may flow in seven (7) 2-1 directions, and may flow to the first header 41 through the connection tube (43) connected to the first region of the first header 41. This fluid may flow in five (5) 2-1 directions, may return to the second header 42 through the connection tube (43) connected to the first region of the second header 42, and may be then discharged through the fluid outlet O.

On the fluid path, the fluid may alternately pass through the connection tubes in the 2-1 and 2-2 directions, and the number thereof may decrease in a backward direction, to have 22-18-14-12-10-7-5. For example, according to an increase in density of the fluid, which had a small density around the fluid inlet, due to heat exchange, cooling efficiency may be improved by reducing the number of connection tubes (13, 23, 33, and 43) to proportionally reduce a cross-sectional area, to allow appropriate cooling to be performed in a section in which a phase of the fluid is changed.

Figure 8A:
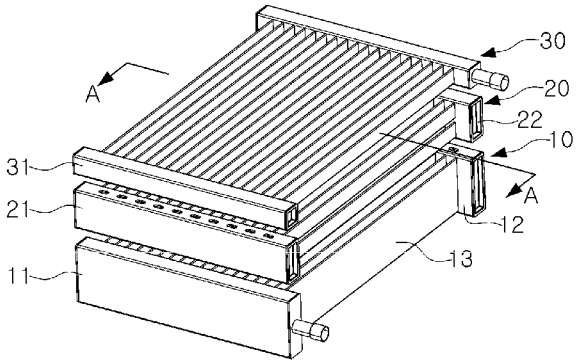
FIG. 8A is a schematic perspective view of a condenser according to another embodiment of the present disclosure.
Figure 8B:
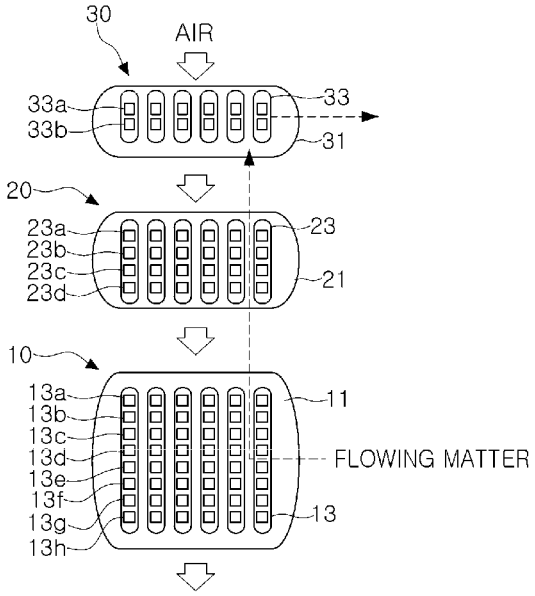
FIG. 8B is a schematic cross-sectional view taken along line A-A of the condenser of FIG. 8A.

FIG. 8A illustrates a schematic perspective view of a condenser according to another embodiment of the present disclosure, and FIG. 8B illustrates a schematic partial cross-sectional view of the condenser of FIG. 8A, taken along line A-A.

As illustrated in FIGS. 8A and 8B, a condenser according to this embodiment may include first to third header rows 10, 20, and 30, and each of the header rows may include a first header (11, 21, and 31) and a second header (12, 22, and 32), extending in a first direction, and a plurality of connection tubes (13, 23, and 33) extending in a second direction and connecting the first header (11, 21, and 31) and the second header (12, 22, and 32), wherein the first to third header rows 10, 20, and 30 may be stacked in a third direction.

A fluid entering a fluid inlet may flow in a 2-1 direction through the connection tube (13) in the first header row 10, may flow in a 2-2 direction through the connection tube (23) in the second header row 20, may flow again in the 2-1 direction through the connection tube (33) in the third header row 30, and may be then discharged through a fluid outlet.

Each of the connection tubes (13, 23, and 33) may include a plurality of microtubules (13*a* to 13*h*, 23*a* to 23*d*, 33*a*, and 33*b*) that occupy a portion of the connection tubes (13, 23, and 33). A cross-sectional area of each of the microtubules (13*a* to 13*h*, 23*a* to 23*d*, 33*a*, and 33*b*) may be constant, but the number of microtubules (13*a* to 13*h*, 23*a* to 23*d*, 33*a*, and 33*b*) included in each of the header rows 10, 20, and 30 may decrease as it approaches the fluid outlet, e.g., the third header row 30. Therefore, as a direction thereof in the second direction is changed, a sum of cross-sectional areas through which the fluid passes may be small.

For example, since six (6) connection tubes (13) may be connected to the first header 11 in the first header row 10, and each of the connection tubes (13) may include eight (8) microtubules (13*a* to 13*h*), a sum of cross-sectional areas in flowing the fluid in the first header row 10 in the 2-1 direction may be 6×8×a microtubule cross-sectional area. Since six (6) connection tubes (23) may be connected to the second header (22) in the second header row 20, and each of the connection tubes (23) may include four (4) microtubules (23*a* to 23*d*), a sum of cross-sectional areas in flowing the fluid in the second header row 20 in the 2-2 direction may be 6×4×a microtubule cross-sectional area. Since six (6) connection tubes (33) may be connected to the first header 31 in the third header row 30, and each of the connection tubes (33) may include two (2) microtubules (33*a* and 33*b*), a sum of cross-sectional areas in flowing the fluid in the third header row 30 in the 2-1 direction may be 6×2×a microtubule cross-sectional area.

Since the cross-sectional areas of the microtubules may be the same, as a direction thereof is changed while passing through the first to third header rows 10, 20, and 30, the sum of cross-sectional areas may be reduced to have 48→24→12. For example, according to an increase in density of the fluid, which had a small density around the fluid inlet, due to heat exchange, cooling efficiency may be improved by reducing the number of microtubules through which the fluid passes to reduce a cross-sectional area, to allow appropriate cooling to be performed in a section in which a phase of the fluid is changed.

Figure 9A:
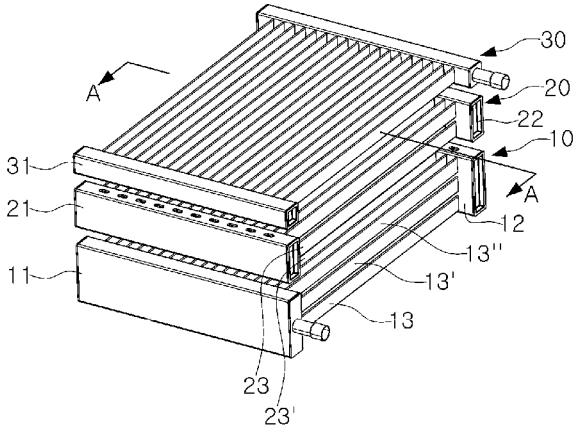
FIG. 9A is a schematic perspective view of a condenser according to another embodiment of the present disclosure.
Figure 9B:
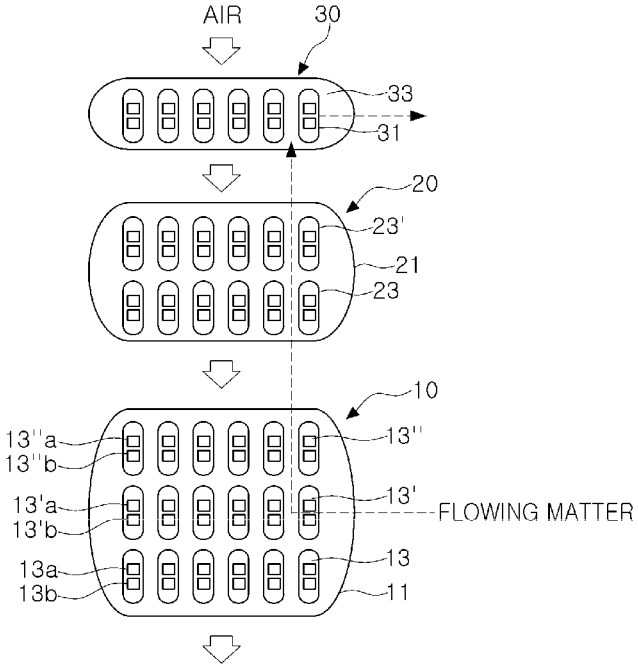
FIG. 9B is a schematic cross-sectional view taken along line A-A of the condenser of FIG. 9A.

FIG. 9A illustrates a schematic perspective view of a condenser according to another embodiment of the present disclosure, and FIG. 9B illustrates a schematic partial cross-sectional view of the condenser of FIG. 9A, taken along line A-A.

As illustrated in FIGS. 9A and 9B, a condenser according to this embodiment may include first to third header rows 10, 20, and 30, and each of the header rows may include a first header (11, 21, and 31) and a second header (12, 22, and 32), extending in a first direction, and a plurality of connection tubes (13, 23, and 33) extending in a second direction and connecting the first header (11, 21, and 31) and the second header (12, 22, and 32), wherein the first to third header rows 10, 20, and 30 may be stacked in a third direction.

In this embodiment, the header rows 10 and 20 may include the connection tubes (13, 23, and 33) as a plurality of rows. For example, the first header row 10 may include a first row connection tube 13, a second row connection tube 13', and a third row connection tube 13". Since the connection tubes (13, 13', and 13") may be included as a plurality of rows, it is possible to include more connection tubes (13, 13', and 13") when headers (11, 21, and 31) of the same length are included.

A fluid entering a fluid inlet may flow in a 2-1 direction through the connection tubes (13, 13', and 13") in the first header row 10, may flow in a 2-2 direction through the connection tubes (23 and 23') in the second header row 20, and may flow again in the 2-1 direction through the connection tube (33) in the third header row 30, and may be then discharged through a fluid outlet.

Each of the connection tubes (13, 13',13", 23, 23', and 33) may include a plurality of microtubules (13*a*, 13*b*, 13'*a*, 13'*b*, 13"*a*, 13"*b*, 23*a*, 23*b*, 23'*a*, 23'*b*, 33*a*, and 33*b*) that occupy a portion of the connection tubes (13, 13', 13", 13', 23, 23', and 33). A cross-sectional area of each of the microtubules (13*a*, 13*b*, 13'*a*, 13'*b*, 13"*a*, 13"*b*, 23*a*, 23*b*, 23'*a*, 23'*b*, 33*a*, and 33*b*) may be substantially constant, but the number of microtubules (13*a*, 13*b*, 13'*a*, 13'*b*, 13"*a*, 13"*b*, 23*a*, 23*b*, 23'*a*, 23'*b*, 33*a*, and 33*b*) disposed in each of the connection tubes (13, 13', 13", 13', 23', 23', and 33) may be the same. The number of connection tubes (13, 13', 13", 13', 23', 23', and 33) in each of the header rows 10, 20, and 30 may decrease as it approaches the fluid outlet, e.g., the third header row 30. Therefore, as a direction thereof in the second direction is changed, a sum of cross-sectional areas through which the fluid passes may be small.

For example, in the first header row 10, the fluid may pass through the microtubules (13*a*, 13*b*, 13'*a*, 13'*b*, 13"*a*, and 13"*b*) of the connection tubes (13, 13'*a*, and 13'*b*) in three (3) rows of six (6) connected to the first header 11. Therefore, a sum of cross-sectional areas in flowing the fluid in the first header row 10 in the 2-1 direction may be 6×3×2×a microtubule cross-sectional area. In the second header row 20, since the connection tubes (23) in two (2) rows of six (6) may be connected to the second header 22, and each of the connection tubes (23 and 23') may include two (2) microtubules (23*a*, 23*b*, 23'*a*, and 23'*b*), a sum of cross-sectional areas in flowing the fluid in the second header row 20 in the 2-2 direction may be 6×2×2×a microtubule cross-sectional area. In the third header row 30, since the connection tubes (33) in one (1) row of six (6) may be connected to the first header 31, and each of the connection tubes (33) may include two (2) microtubules (33*a* and 33*b*), a sum of cross-sectional areas in flowing the fluid in the third header row 30 in the 2-1 direction may be 6×1×2×a microtubule cross-sectional area.

Since the cross-sectional areas of the microtubules may be the same, as a direction thereof is changed while passing through the first to third header rows 10, 20, and 30, the sum of cross-sectional areas may be reduced to have 36→24→12. For example, according to an increase in density of the fluid, which had a small density around the fluid inlet, due to heat exchange, cooling efficiency may be improved by reducing the number of microtubules through which the fluid passes to reduce a cross-sectional area, to allow appropriate cooling to be performed in a section in which a phase of the fluid is changed.

Figure 10A:
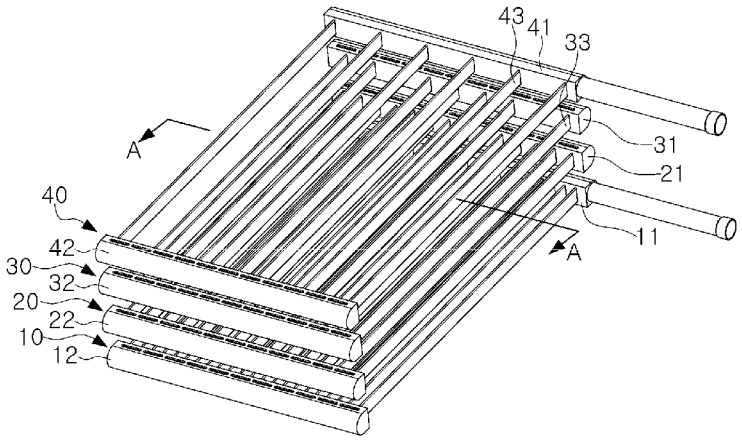
FIG. 10A is a schematic perspective view of a condenser according to another embodiment of the present disclosure.
Figure 10B:
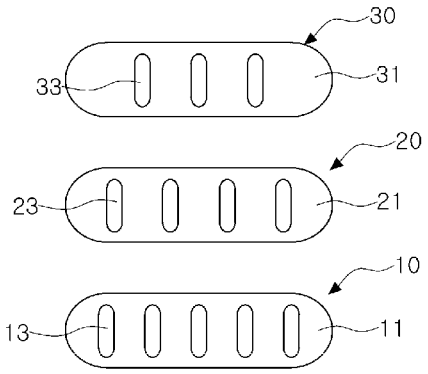
FIG. 10B is a schematic cross-sectional view taken along line A-A of the condenser of FIG. 10A.

FIG. 10A illustrates a schematic perspective view of a condenser according to another embodiment of the present disclosure, and FIG. 10B illustrates a schematic cross-partial view of the condenser of FIG. 10A, taken along line A-A.

As illustrated in FIGS. 10A and 10B, a condenser according to this embodiment may include first to fourth header rows 10, 20, 30, and 40, and each of the header rows may include a first header (11, 21, 31, and 41) and a second header (12, 22, 32, and 42), extending in a first direction, and a plurality of connection tubes (13, 23, 33, and 43) extending in a second direction and connecting the first header (11, 21, 31, and 41) and the second header (12, 22, 32, and 42), wherein the first to fourth header rows 10, 20, 30, and 40 may be stacked in a third direction.

A fluid entering a fluid inlet may flow in a 2-1 direction through the connection tube (13) in the first header row 10, may flow in a 2-2 direction through the connection tube (23) in the second header row 20, may flow again in the 2-1 direction through the connection tube (33) in the third header row 30, may flow again in the 2-2 direction through the connection tube (43) in the fourth header row 40, and may be then discharged through a fluid outlet.

Each of the header rows 10, 20, 30, and 40 may be stacked with the same length in the first direction, but the number of connection tubes (13, 23, 33, and 43) included in each of the header rows 10, 20, 30, and 40 may be different. The number of connection tubes (13, 23, 33, and 43) included in each of the header rows 10, 20, 30, and 40 may decrease as it approaches the fluid outlet. A cross-sectional area of each of the connection tubes 13, 23, and 33 may be the same. The connection tubes (13, 23, 33, and 43) in the header rows 10, 20, 30, and 40 may include microtubules, and the number of microtubules may be the same in the connection tubes (13, 23, 33, and 43) in the first to fourth header rows 10, or, at least, the number of microtubules in the first header row may be larger than the number of microtubules in the fourth header row 40.

For example, six (6) connection tubes (13) may be connected to the first header 11 in the first header row 10, and a sum of cross-sectional areas in flowing the fluid in the first header row 10 in the 2-1 direction may be 6×a connection tube cross-sectional area. Since five (5) connection tubes (23) may be connected to the second header (22) in the second header row 20, a sum of cross-sectional areas in flowing the fluid in the second header row 20 in the 2-2 direction may be 5×a connection tube cross-sectional area.

Since four (4) connection tubes (33) may be connected to the first header 31 in the third header row 30, a sum of cross-sectional areas in flowing the fluid in the third header row 30 in the 2-1 direction may be 4×a connection tube cross-sectional area. Since three (3) connection tubes (43) may be connected to the second header 42 in the fourth header row 30, a sum of cross-sectional areas in flowing the fluid in in the fourth header row 30 in the 2-2 direction may be 3×a connection tube cross-sectional area.

Since the cross-sectional areas of the connection tubes (13, 23, 33, and 43) may be the same, as a direction thereof is changed while passing through the first to fourth header rows 10, 20, 30, and 40, the sum of cross-sectional areas may be reduced to have 6→5→4→3. For example, according to an increase in density of the fluid, which had a small density around the fluid inlet, due to heat exchange, cooling efficiency may be improved by reducing the number of microtubules through which the fluid passes to reduce a cross-sectional area, to allow appropriate cooling to be performed in a section in which a phase of the fluid is changed.

Figure 11A:
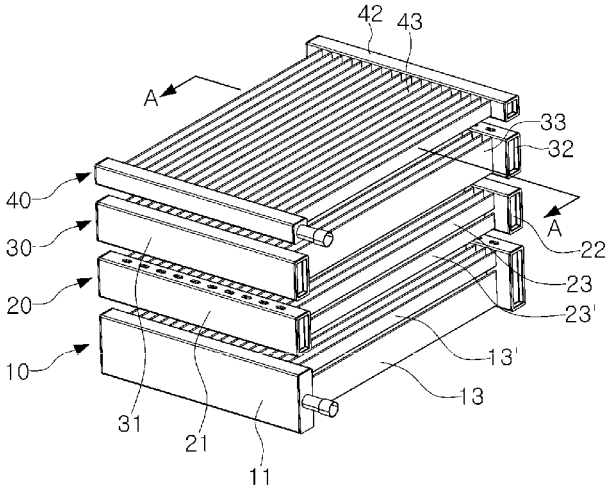
FIG. 11A is a schematic perspective view of a condenser according to another embodiment of the present disclosure.
Figure 11B:
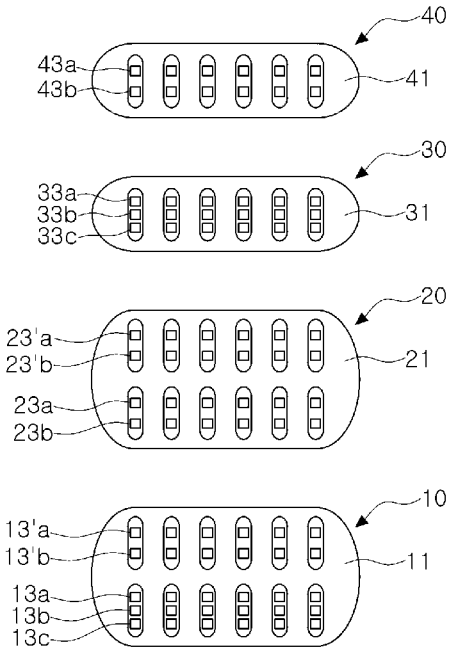
FIG. 11B is a schematic partial view taken along line A-A of the condenser of FIG. 11A.

FIG. 11A illustrates a schematic perspective view of a condenser according to another embodiment of the present disclosure, and FIG. 11B illustrates a schematic partial cross-sectional view of the condenser of FIG. 11A, taken along line A-A.

As illustrated in FIGS. 11A and 11B, a condenser according to this embodiment may include first to fourth header rows 10, 20, 30, and 40, and each of the header rows may include a first header (11, 21, 31, and 41) and a second header (12, 22, 32, and 42), extending in a first direction, and a plurality of connection tubes (13, 13', 23, 23', 33, and 43) extending in a second direction and connecting the first header (11, 21, 31, and 41) and the second header (12, 22, 32, and 42), wherein the first to fourth header rows 10, 20, 30, and 40 may be stacked in a third direction.

A fluid entering a fluid inlet may flow in a 2-1 direction through the connection tubes (13 and 13') in the first header row 10, may flow in a 2-2 direction through the connection tubes (23 and 23') in the second header row 20, may flow again in the 2-1 direction through the connection tube (33) in the third header row 30, may flow again in the 2-2 direction through the connection tube (43) in the fourth header row 40, and may be then discharged through a fluid outlet.

In this embodiment, the header rows 10 and 20 may include the connection tubes (13, 13', 23, and 23') as a plurality of rows. For example, the first header row 10 may include a first row connection tube 13 and a second row connection tube 13', and the second header row 20 may include a first row connection tube 23 and a second row connection tube 23'. Since the connection tubes (13, 13', 23, and 23') may be included as a plurality of rows, it is possible to include more connection tubes (13, 13', 23, and 23') when headers (11, 21, 31, and 41) of the same length are included.

In addition, each of the connection tubes (13, 13', 23, 23', 33, and 43) may include a plurality of microtubules (13*a* to 13*c*, 13'*a*, 13'*b*, 23*a*, 23*b*, 23'*a*, 23'*b*, 33*a* to 33*c*, 43*a*, and 43*b*) that occupy a portion of the connection tubes (13, 13', 23, 23', 33, and 43). A cross-sectional area of each of the microtubules (13*a* to 13*c*, 13'*a*, 13'*b*, 23*a*, 23*b*, 23'*a*, 23'*b*, 33*a* to 33*c*, 43*a*, and 43*b*) may be constant. The number of microtubules (13*a* to 13*c*, 13'*a*, 13'*b*, 23*a*, 23*b*, 23'*a*, 23'*b*, 33*a* to 33*c*, 43*a*, and 43*b*) included in each of the connection tubes (13 and 33) in the first to fourth header rows 10, 20, 30, and 40 may be the same, but in this embodiment, the first row connection tube (13) in the first header row 10 and the connection tube (33) in the third header row 30 may include three (3) microtubules (13*a* to 13*c*, and 33*a* to 33*c*), and remaining connection tubes (13', 23, 23', and 43) may include two (2) microtubules (13'*a*, 13'*b*, 23*a*, 23*b*, 23'*a*, 23'*b*, 43*a*, and 43*b*).

In this embodiment, the number of microtubules (13*a* to 13*c*, 13'*a*, 13'*b*, 23*a*, 23*b*, 23'*a*, 23'*b*, 33*a* to 33*c*, 43*a*, and 43*b*) included in the connection tubes (13, 13', 23, 23', 33, and 43) in each of the header rows 10, 20, 30, and 40 may decrease as it approaches the fluid outlet, e.g., the fourth header row 40. Therefore, as a direction thereof in the second direction is changed, a sum of cross-sectional areas through which the fluid passes may be small.

For example, in the first header row 10, six (6) connection tubes (13 and 13') in two (2) rows may be connected to the first header 11, three (3) microtubules (13*a* to 13*c*) may be included in the first row connection tube (13) and two (2) microtubules (13'*a* and 13'*b*) may be included in the second row connection tube (13'). Therefore, a sum of cross-sectional areas in flowing the fluid in the first header row 10 in the 2-1 direction may be (6×3+6×2)×a microtubule cross-sectional area. In the second header row 20, six (6) connection tubes (23 and 23') in two (2) rows may be connected to the second header 22, and each of the connection tubes (23 and 23') may include two (2) microtubules (23*a*, 23*b*, 23'*a*, and 23'*b*). Therefore, a sum of cross-sectional areas in flowing the fluid in the second header row 20 in the 2-2 direction may be 6×2×2×a microtubule cross-sectional area. In the third header row 30, six (6) connection tubes (33) may be connected to the first header 31, and each of the connection tubes (33) may include three (3) microtubules (33*a* to 33*c*). Therefore, a sum of cross-sectional areas in flowing the fluid in the third header row 30 in the 2-1 direction may be 6×3×a microtubule cross-sectional area. In the fourth header row 40, six (6) connection tubes (43) may be connected to the second header 42, and each of the connection tubes (43) may include two (2) microtubules (43*a* to 43*c*). Therefore, a sum of cross-sectional areas in flowing the fluid in the fourth header row 40 in the 2-2 direction may be 6×2×a microtubule cross-sectional area.

Since the cross-sectional areas of the microtubules may be the same, as a direction thereof is changed while passing through the first to fourth header rows 10, 20, 30, and 40, the sum of cross-sectional areas may be reduced to have 30→24→18→12. For example, according to an increase in density of the fluid, which had a small density around the fluid inlet, due to heat exchange, cooling efficiency may be improved by reducing the number of microtubules through which the fluid passes to reduce a cross-sectional area, to allow appropriate cooling to be performed in a section in which a phase of the fluid is changed.

Figure 12A:
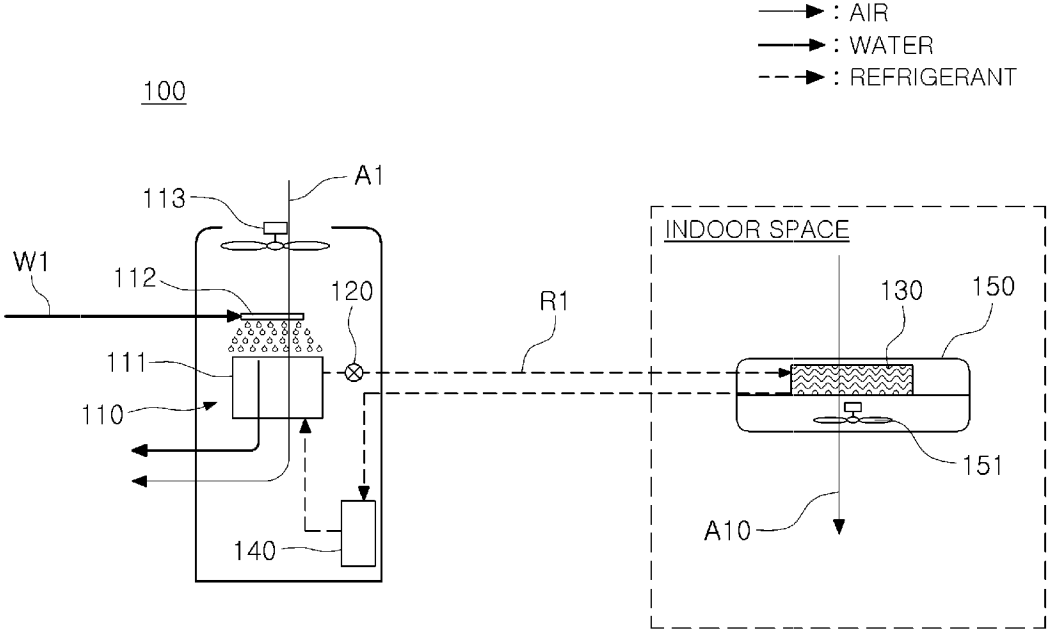
FIG. 12A is a schematic view of an air conditioner according to a first embodiment of the present disclosure.

FIG. 12A illustrates a schematic view of an air conditioner according to a first embodiment of the present disclosure. As illustrated in FIG. 12A, an air conditioner according to a first embodiment of the present disclosure may include a refrigerant cycle R1 including an evaporative condenser 110 in which a compressed refrigerant is condensed, an expansion valve 120 in which the refrigerant passing through the evaporative condenser 110 expands, an evaporator 130 in which the refrigerant passing through the expansion valve 120 is evaporated, and a compressor 140 in which the refrigerant passing through the evaporator 130 is compressed.

The evaporative condenser 110 may include a condensation module 111 including a fluid passage; a water injection module 112 disposed on the condensation module and spraying water passing through the condensation module 111; and a blowing module 113 disposed on one side of the condensation module 111 and providing air passing through the condensation module 111. In the air conditioner of the first embodiment, the condensation module 111 may be the condensation module 1 described in FIGS. 1 to 11, and the water injection module 112 and the blowing module 113 may be applied by the water injection module 90 and the blowing module 95 of FIG. 3.

The evaporative condenser 110 may be installed in an outdoor unit located in an indoor space spatially separated from an outdoor space. In the condensation module 111, an air flow path A1 receiving air externally, passing the air through the condensation module 111, increasing a temperature thereof, and discharging the air, a water supply flow path W1 connected to a water supply source, spraying water to the condensation module 111 by the water injection module 112, and discharging the water below the condensation module 111, and the refrigerant cycle R1, may be proceeded, to condense the refrigerant by the air in the air flow path A1 and the water in the water supply flow path W1.

Since the condensation module 111 may heat-exchange with the water and the air while the refrigerant passes through a three-dimensional structure formed in three directions: an extension direction of a header, an extension direction of a connection tube, and a stacking direction of header rows, more heat exchange occurs even when it occupies the same volume. As a result, cooling efficiency may be improved.

The evaporator 130 through which the refrigerant cycle R1 passes may be disposed in an indoor unit 150, the indoor unit 150 may include a blower 151, and the blower 151 may blow indoor air through the evaporator 130. Thereafter, a circulation flow path A10 supplied to the indoor space again may be formed.

Figure 12B:
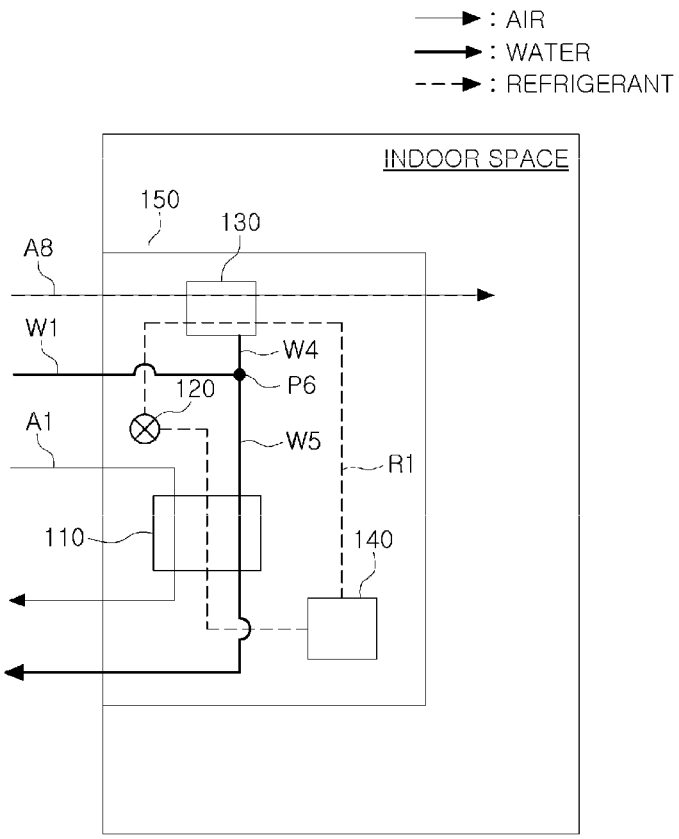
FIGS. 12B, 12C, and 12D are schematic views of an air conditioner according to a modified example of the first embodiment of the present disclosure.

FIG. 12B illustrates a schematic view of an air conditioner according to a modified example of the first embodiment of the present disclosure. As illustrated in FIG. 12B, the air conditioner of the modified example of the present disclosure may include a refrigerant cycle R1 including an evaporative condenser 110 in which a compressed refrigerant is condensed, an expansion valve 120 in which the refrigerant passing through the evaporative condenser 110 expands, an evaporator 130 in which the refrigerant passing through the expansion valve 120 is evaporated, and a compressor 140 in which the refrigerant passing through the evaporator 130 is compressed.

Although not illustrated, the evaporative condenser 110 may include a condensation module including a fluid passage; a water injection module disposed on the condensation module and spraying water passing through the condensation module 111; and a blowing module disposed on one side of the condensation module and providing air passing through the condensation module, similarly to FIG. 12A. The condensation module in the air conditioner of the first modified example may be the condensation module described above.

All configurations through which the refrigerant cycle R1 passes may be disposed in an indoor unit 150. For example, the refrigerant cycle R1 may be driven in an indoor space. The configurations may not necessarily have to be disposed in the indoor space, and when the configurations are disposed in one space, e.g., in one case, the case itself may be disposed in an outdoor space. For example, the case may be disposed in the outdoor space, and may be changed and employed to draw indoor air, pass the indoor air through the evaporator 130 to cool the same, and return the same to the indoor space again.

In the condensation module, an air flow path A1 receiving air externally, passing the air through the condensation module, increasing a temperature thereof, and discharging the air, a water supply flow path W1 connected to a water supply source, spraying water to the condensation module by the water injection module, and discharging the water below the condensation module, and the refrigerant cycle R1, may be proceeded, to condense the refrigerant by the air in the air flow path A1 and the water in the water supply flow path W1.

A circulation flow path A10 through which indoor air circulates may pass through the evaporator 130, and condensed water generated from the evaporator 130 may pass through a condensed water flow path W4, may meet at a junction P6, and may be supplied to the evaporative condenser 110. It is also possible for the condensed water flow path W4 to pass through the condensation module through the water injection module without merging with the water supply flow path W1. Since indoor moisture is condensed in a case of condensed water, cooling efficiency may be improved in view of the facts that water may be poured into the condensation module without water supply and a temperature thereof may be low since the condensed water comes from the evaporator 130. In the condensed water, since an amount thereof may be insufficient to meet a cooling load required by the evaporative condenser 110, the water supply flow path W1 may be required.

The evaporator 130 may be located above the evaporative condenser 110, and when condensed water is supplied to the evaporative condenser 110 by a self load of the condensed water in the condensed water flow path W4, the condensed water may be supplied to the evaporative condenser 110 without additional power.

Since the condensation module of the evaporative condenser 110 may exchange heat with the water and the air, as the refrigerant passes through a three-dimensional structure formed in three (3) directions, in an extension direction of a header, in an extension direction of a connection tube, and in a stacking direction of a header row, even when the same volume is occupied, more heat exchange is possible, and cooling performance may be improved.

Figure 12C:
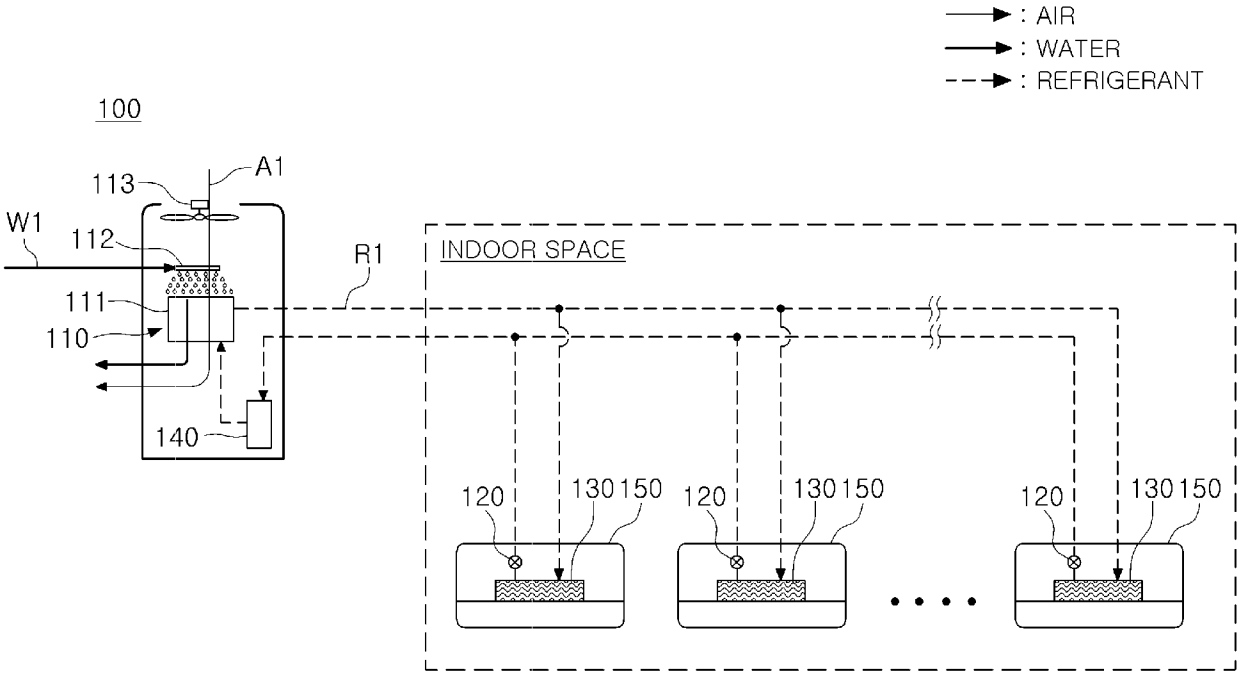
Figure 12D:
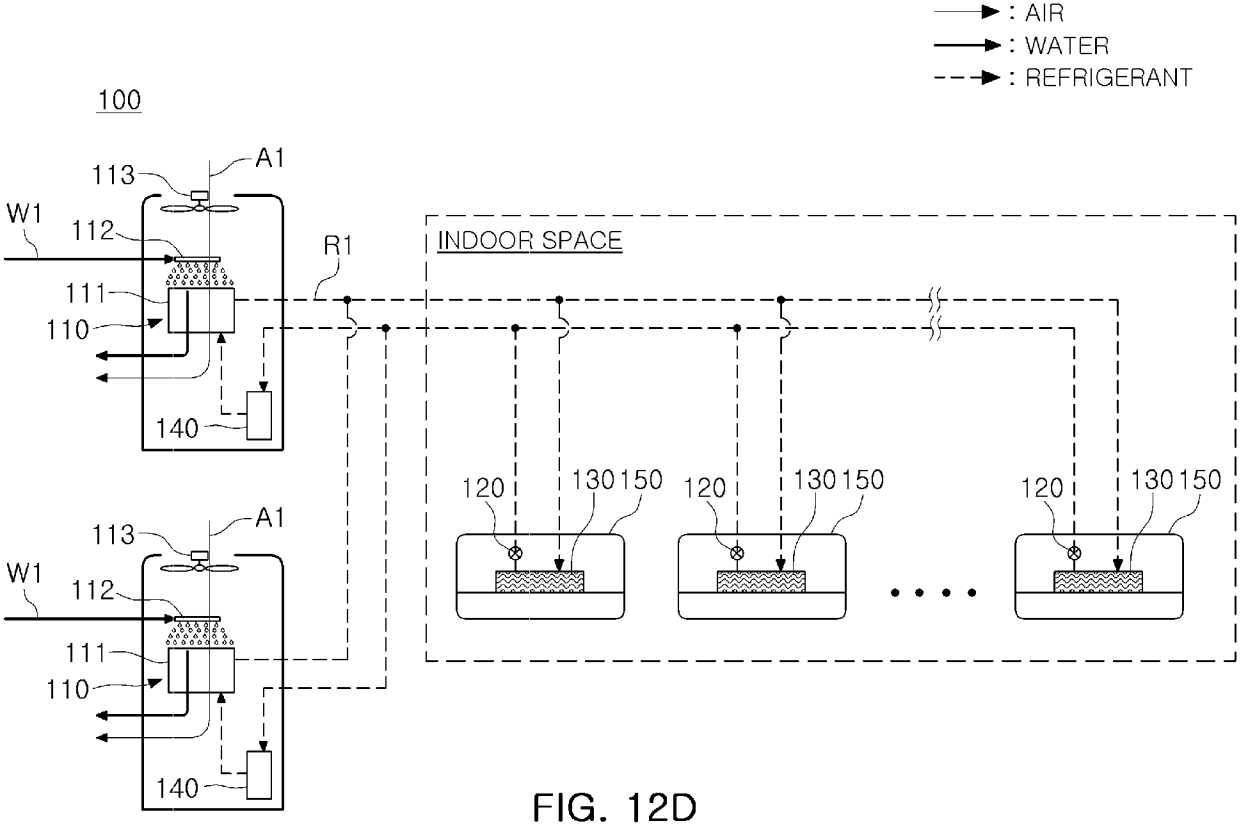

FIGS. 12C and 12D illustrate schematic views of an air conditioner according to another modified example of the first embodiment of the present disclosure.

In FIGS. 12C and 12D, configurations of an indoor unit and an outdoor unit may not be different from those of FIG. 12A. In FIG. 12C, a plurality of indoor units 150 may be connected to one outdoor unit, a plurality of evaporators 130 may be equipped in a refrigerant cycle R1, and they may be branched and then joined. In FIG. 12D, a plurality of indoor units 150 may be connected to a plurality of outdoor units, a refrigerant cycle R may be branched into an indoor unit and an outdoor unit, and then joined. A plurality of indoor units and a plurality of outdoor units may be configured as one cycle, and a plurality of outdoor units may be connected to one indoor unit.

Figure 13:
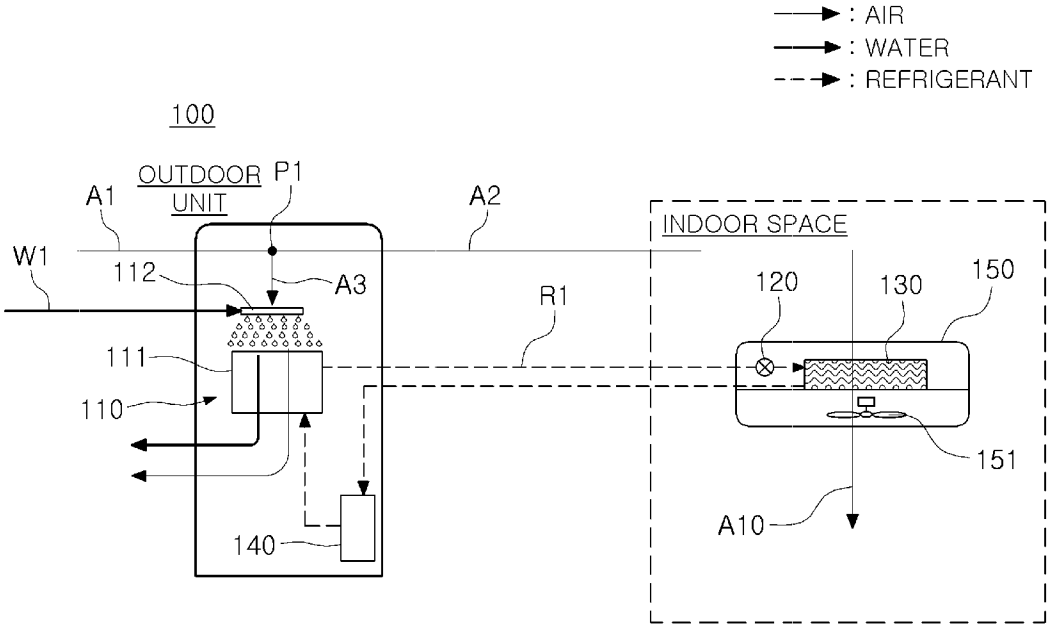
FIG. 13 is a schematic view of an air conditioner according to a second embodiment of the present disclosure.

FIG. 13 illustrates a schematic view of an air conditioner according to a second embodiment of the present disclosure. As illustrated in FIG. 13, an air conditioner according to a second embodiment of the present disclosure may include a refrigerant cycle R1 including an evaporative condenser 110 in which a compressed refrigerant is condensed, an expansion valve 120 in which the refrigerant passing through the evaporative condenser 110 expands, an evaporator 130 in which the refrigerant passing through the expansion valve 120 is evaporated, and a compressor 140 in which the refrigerant passing through the evaporator 130 is compressed.

The evaporative condenser 110 may include a condensation module 111 including a fluid passage; a water injection module 112 disposed on the condensation module 111 and spraying water passing through the condensation module; and a blowing module (not illustrated) disposed on one side of the condensation module 111 and providing air passing through the condensation module 111. In the air conditioner of the second embodiment, the condensation module 111 may be the condensation module 1 described in FIGS. 1 to 11, and the water injection module 112 and the blowing module 113 may be applied by the water injection module 90 and the blowing module 95 of FIG. 3.

The evaporative condenser 110 may be installed in an outdoor unit disposed in a position spatially separated from an indoor space. An air flow path A1 connected to the outside to supply air to the condenser module 111, and a discharge flow path A2 discharging air of the indoor space may merge at a junction P1, and may be connected to a condenser supply flow path A3, and the blowing module may be installed in the condenser supply flow path A3 to provide external air and indoor air to the condenser module 111. Air in the condenser supply flow path A3 may pass through the condenser module 111, and may be then discharged to the outside after a temperature thereof rises. A water supply flow path W1 connected to a water supply source may spray water to the condensation module 111 by the water injection module 112, and may discharge the water below the condensation module 111, and the refrigerant cycle R1 may pass through the condensation module 111 to condense the refrigerant by the air of the condenser supply flow path A3 and the water of the water supply flow path W1.

The evaporator 130 through which the refrigerant cycle R1 passes may be disposed in an indoor unit 150, and the indoor unit 150 may include a blower 151, and the blower 151 may blow indoor air through the evaporator 130. Thereafter, a circulation flow path A10 supplied to the indoor space again may be formed in the same manner as in the first embodiment.

Figure 14A:
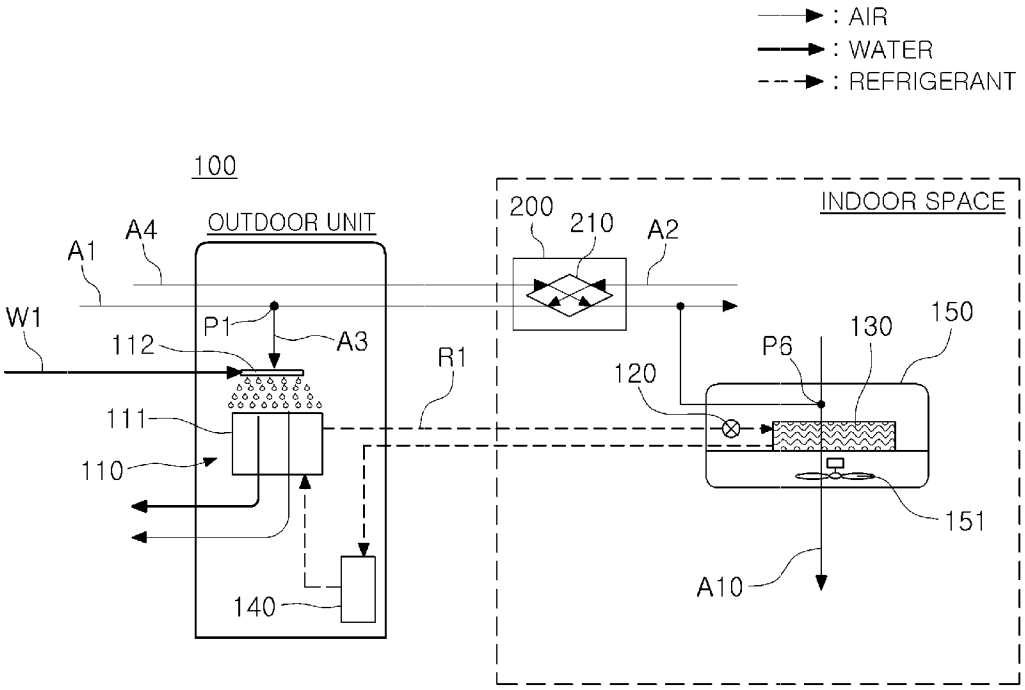
FIG. 14A is a schematic view of an air conditioner according to a third embodiment of the present disclosure.
Figure 14B:
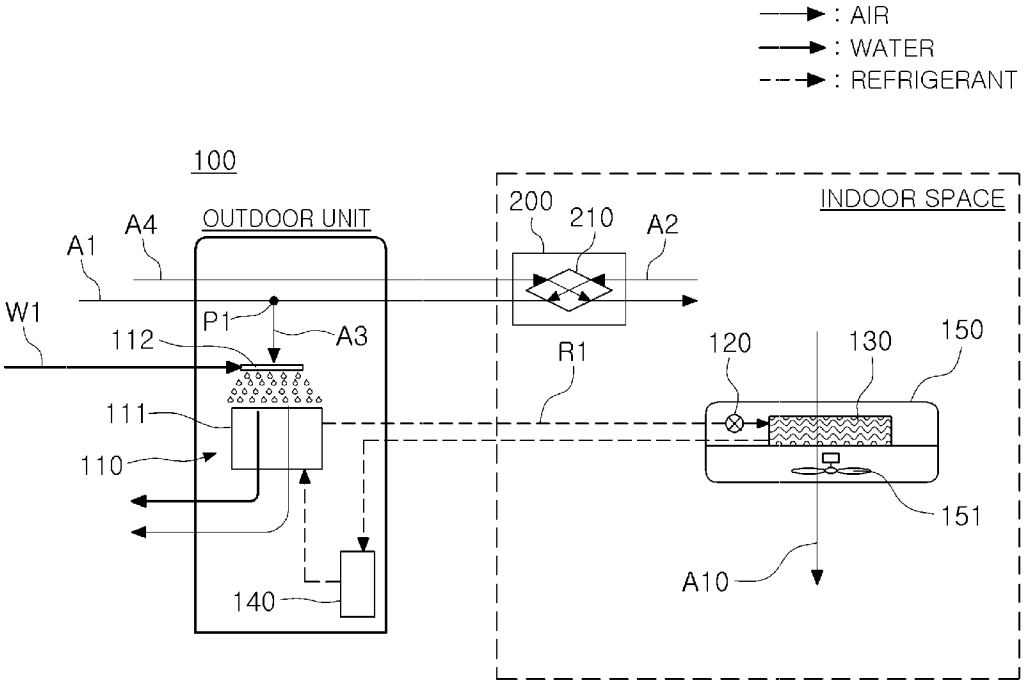
FIGS. 14B and 14C are air conditioners according to a modified example of the third embodiment of the present disclosure.
Figure 14C:
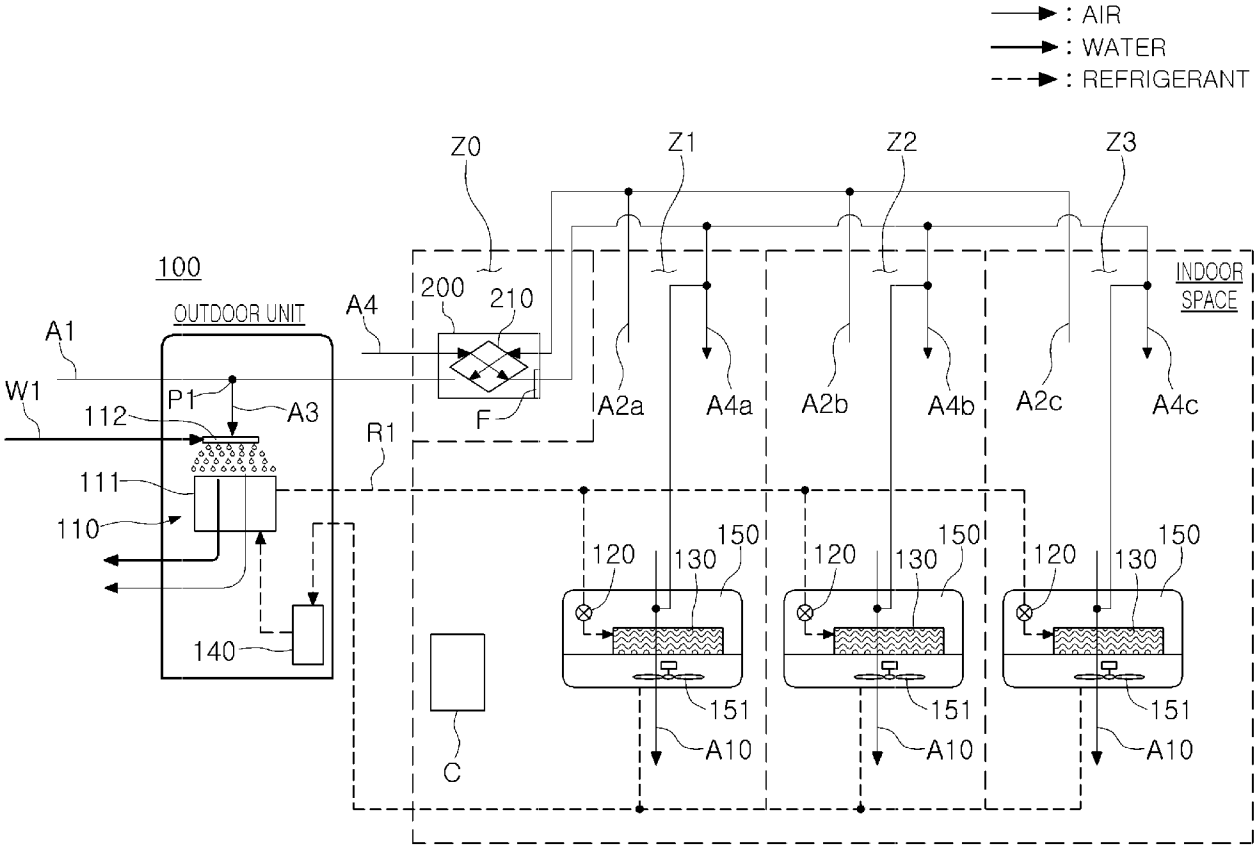

FIGS. 14A to 14C illustrate schematic views of an air conditioner according to a third embodiment of the present disclosure. FIG. 14A illustrates a schematic view of an air conditioner according to a third embodiment, and FIGS. 14B and 14C illustrate air conditioners according to a modified example of the third embodiment. As illustrated in FIG. 14A, an air conditioner of the third embodiment of the present disclosure may include a refrigerant cycle R1 including an evaporative condenser 110 in which a compressed refrigerant is condensed, an expansion valve 120 in which the refrigerant passing through the evaporative condenser 110 expands, an evaporator 130 in which the refrigerant passing through the expansion valve 120 is evaporated, and a compressor 140 in which the refrigerant passing through the evaporator 130 is compressed, in the same manner as in the first embodiment and the second embodiment.

The evaporative condenser 110 may include a condensation module 111 including a fluid passage; a water injection module 112 disposed on the condensation module 111 and spraying water passing through the condensation module; and a blowing module (not illustrated) disposed on one side of the condensation module 111 and providing air passing through the condensation module 111. The condensation module 111 may be the condensation module 1 described in FIGS. 1 to 11, in the same manner as in the first embodiment and the second embodiment.

The evaporative condenser 110 may be installed in an outdoor unit disposed in a position spatially separated from an indoor space. An air flow path A1 connected to the outside to supply air to the condenser module 111, and a discharge flow path A2 discharging air of the indoor space may merge at a junction P1, and may be connected to a condenser supply flow path A3. In the third embodiment, the air conditioner may further include a supply flow path A4 through which air is introduced into the indoor space from the outside, and a ventilation heat exchanger 200 disposed on the supply flow path A4 and the discharge flow path A2 and configured to cross and heat-exchange between the air supplied to the indoor space and the air discharged to the outdoor space. The ventilation heat exchanger 200 may include a heat exchange unit 21 in which the supply flow path A4 and the discharge flow path A2 intersect and exchange heat. In this case, the ventilation heat exchanger 200 may be located in the indoor space, but may be disposed at a location other than the indoor space, for example, an outdoor space. The supply flow path A4 supplied the indoor space through the heat exchange unit 210 of the ventilation heat exchanger 200 may branch at a branch point, and may merge with a circulation flow path A10 at a junction P6 of the circulation flow path A10 before being supplied to the evaporator 130, or may be supplied into the indoor space without merging. An air supply direction of the supply flow path A4 may be determined depending on a situation, and may be configured to supply only onto one side thereamong.

The blowing module may be installed in the condenser supply flow path A3 to provide external air and indoor air to the condensation module 111. Air in the condenser supply flow path A3 may pass through the condenser module 111, and may be then discharged to the outside after a temperature thereof rises. A water supply flow path W1 connected to a water supply source may spray water to the condensation module 111 by the water injection module 112, and may discharge the water below the condensation module 111, and the refrigerant cycle R1 may pass through the condensation module 111 to condense the refrigerant by the air of the condenser supply flow path A3 and the water of the water supply flow path W1.

The evaporator 130 through which the refrigerant cycle R1 passes may be disposed in an indoor unit 150, and the indoor unit 150 may include a blower 151, and the blower 151 may blow indoor air through the evaporator 130. Thereafter, the circulation flow path A10 supplied to the indoor space again may be formed in the same manner as in the first embodiment.

In a modified example of the third embodiment of FIG. 14B, the supply flow path A4 of FIG. 14A may be directly supplied to an indoor space without branching, and supplied air may be mixed in the indoor space, and may be then circulated to a circulation flow path A10 of an indoor unit.

A modified example of the third embodiment of FIG. 14C is illustrated to provide the indoor unit 150 of FIG. 14A in a plurality of spaces Z1 to Z3, respectively. A ventilation heat exchanger 200 may be disposed in an installation space Z0 different from the use spaces Z1 to Z3 in which the indoor unit 150 is disposed, such as a ceiling, an outdoor unit chamber, or a multipurpose chamber, and may be disposed in a space such as an outdoor unit. A discharge flow path A2 may include first to third discharge flow paths A2*a* to A2*c* connected to the use spaces Z1 to Z3, and a supply flow path A4 may include first to third supply flow paths A4*a* to A4*c* connected to the use spaces Z1 to Z3.

As illustrated in FIG. 14C, an air conditioner 100 may further include a controller C disposed in an indoor space, and the controller C may adjust a refrigerant cycle R1 and the ventilation heat exchanger 200 to control indoor air in a state desired by a user. In this case, an evaporative condenser 110 of the present disclosure may be used to reduce noise of a compressor disposed in the outdoor unit, to increase energy efficiency, and to save a space. Furthermore, since various modes such as a ventilation cooling mode (operating the ventilation heat exchanger and the refrigerant cycle at the same time), a cooling mode (operating the refrigerant cycle), or a ventilation mode (operating the ventilation heat exchanger) are possible, and a different mode for each use space (Z1 to Z3) is also possible, all of the various requirements of each user according to the use spaces Z1 to Z3 may be satisfied.

Figure 15:
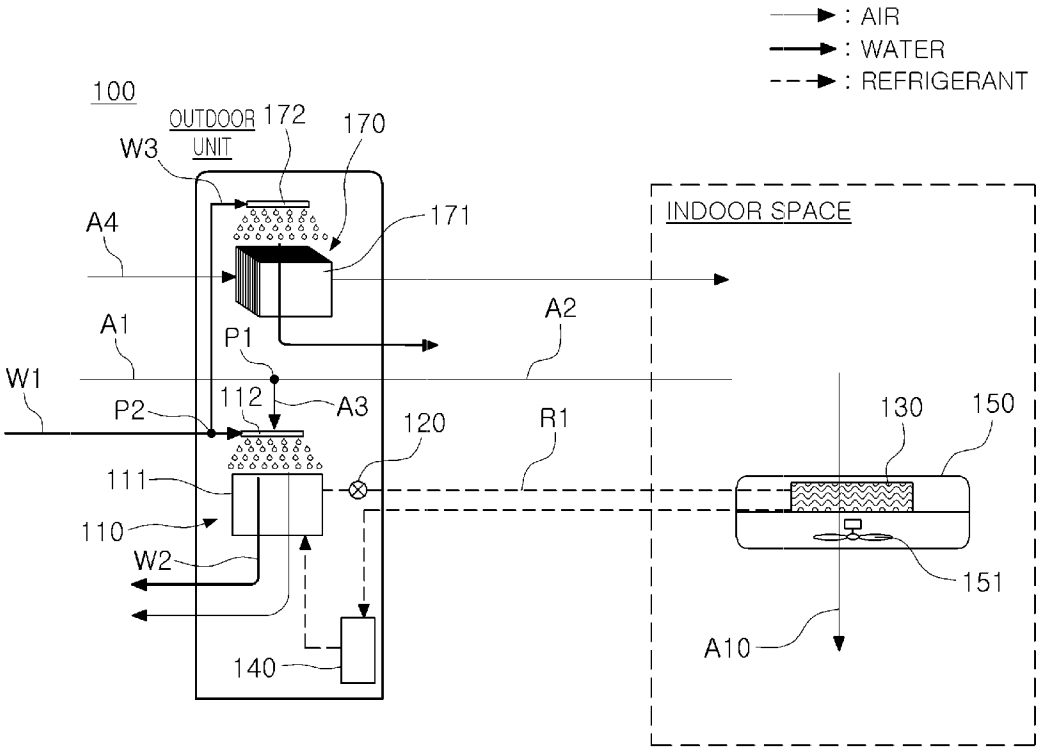
FIG. 15 is a schematic view of an air conditioner according to a fourth embodiment of the present disclosure.

FIG. 15 illustrates a schematic view of an air conditioner according to a fourth embodiment of the present disclosure. As illustrated in FIG. 15, an air conditioner according to a fourth embodiment of the present disclosure may include a refrigerant cycle R1 through which a compressed refrigerant circulates, in the same manner as the first to third embodiments.

An evaporative condenser 110 may include a condensation module 111 including a fluid passage; a water injection module 112 disposed on the condensation module 111 and spraying water passing through the condensation module; and a blowing module (not illustrated) disposed on one side of the condensation module 111 and providing air passing through the condensation module 111.

The evaporative condenser 110 may be installed in an outdoor unit disposed in a position spatially separated from an indoor space. An air flow path A1 connected to the outside to supply air to the condenser module 111, and a discharge flow path A2 discharging air of the indoor space may merge at a junction P1, and may be connected to a condenser supply flow path A3, and the blowing module may be installed in the condenser supply flow path A3 to provide external air and indoor air to the condenser module 111. Air in the condenser supply flow path A3 may pass through the condenser module 111, and may be then discharged to the outside after a temperature thereof rises. A water supply flow path W2 connected to a water supply source may spray water to the condensation module 111 by the water injection module 112, and may discharge the water below the condensation module 111, and the refrigerant cycle R1 may pass through the condensation module 111 to condense the refrigerant by the air of the condenser supply flow path A3 and the water of the water supply flow path W1.

The air conditioner of the fourth embodiment may further include a supply flow path A4 supplying air from the outdoor space to the indoor space, opposite to the discharge flow path A2, and an evaporative cooler 170 installed on the supply flow path A4 and cooling air introduced into the indoor space.

The water supply flow path W1 connected to the water supply source may be branched into a water supply flow path W2 facing the evaporative condenser 110 and a water supply flow path W3 facing the evaporative cooler 170 at a branch point P2, and water providing latent heat for cooling air passing through the evaporative cooler 170 and water providing latent heat for condensing a refrigerant passing through the evaporative condenser 110 may be provided by the water supply flow paths W2 and W3. Water passing through the evaporative cooler 170 may be drained externally.

Water passing through the evaporative cooler 170 and the evaporative condenser 110 may be recycled by collecting the water without drainage thereof and then supplying the water back to the evaporative cooler 170 and/or the evaporative condenser 110, together with water supplied from the water supply source.

The evaporator 130 through which the refrigerant cycle R1 passes may be disposed in an indoor unit 150, the indoor unit 150 may include a blower 151, and the blower 151 may blow indoor air through the evaporator 130. Thereafter, a circulation flow path A10 supplied to the indoor space again may be formed in the same manner as in the first embodiment.

Figure 16:
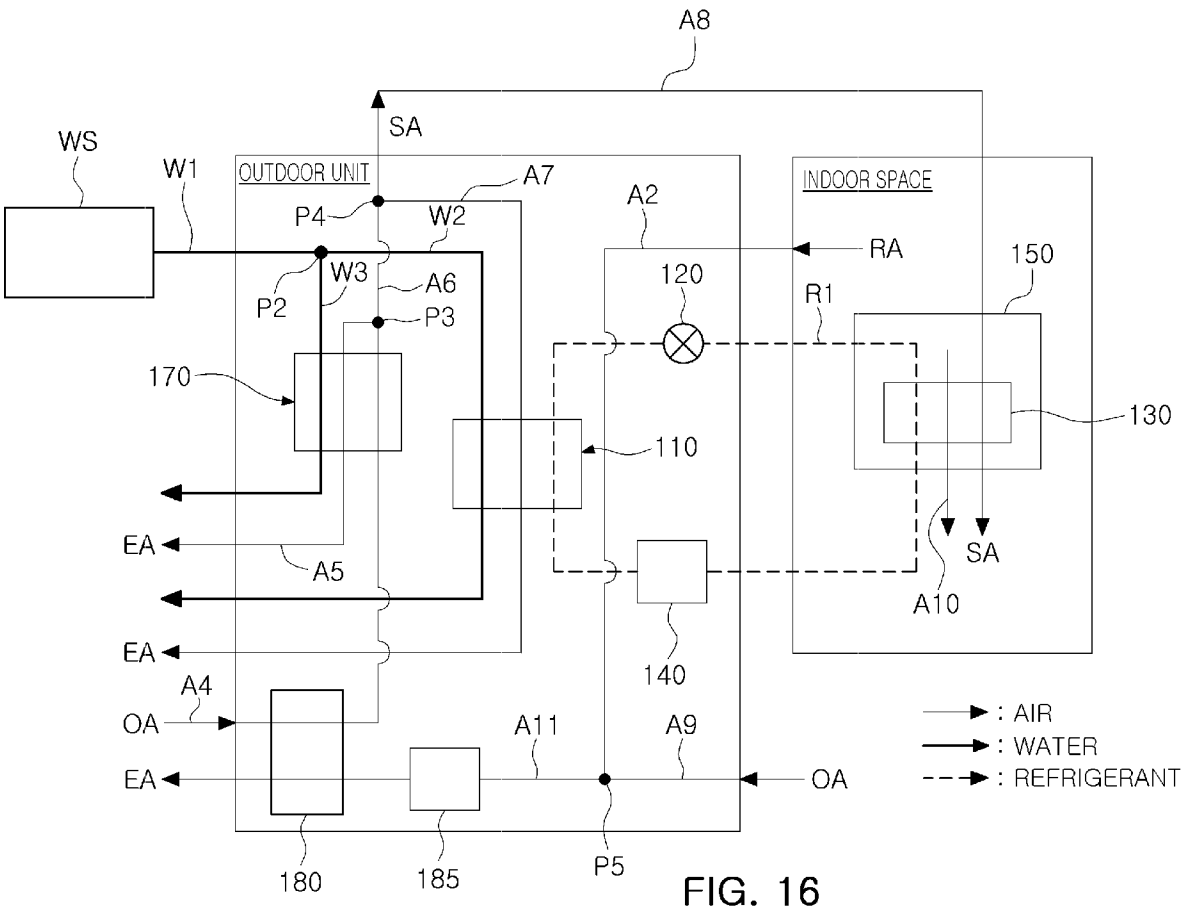
FIG. 16 is a schematic view of an air conditioner according to a fifth embodiment of the present disclosure.

FIG. 16 illustrates a schematic view of a fifth embodiment of the present disclosure. An air conditioner of the fifth embodiment of the present disclosure may include a refrigerant cycle R1 in which a compressed refrigerant is circulated, and the refrigerant cycle R1 may pass through a condenser 110 in which the refrigerant is condensed, and an evaporator 130 in which the refrigerant is evaporated and air is cooled, in the same manner as the first to fourth embodiments.

The air conditioner of the fifth embodiment may include an outdoor unit in which the evaporative condenser 110 is disposed; and an indoor unit 150 in which the evaporator 130 is disposed. The outdoor unit may include an evaporative cooler 170 disposed on an inflow flow path A4 into which air in an outdoor space is introduced, including a dry channel and a wet channel, and cooling the air passing through the dry channel, a dehumidification rotor 180 disposed on the inflow flow path A4 before the evaporative cooler 170 and dehumidifying the introduced air; and a heater 185 disposed on a regeneration flow path (A9 and A11) through which air for regenerating the dehumidification rotor 180 passes, before the dehumidification rotor 80, to heat the air.

The dehumidification rotor 180 may be disposed over the regeneration flow path (A9 and A11) and the inflow flow path A4, and the dehumidification rotor 180 may operate by absorbing moisture in the inflow flow path A4 and discharging the absorbed moisture in the regeneration flow path (A9 and A11). The inflow flow path A4 may pass through the evaporative cooler 170, and may be branched into an indoor supply flow path A8 connected to an indoor space at a branch point (P3 and P4), a condenser supply flow path A7 connected to the evaporative condenser 110, and a cooler supply flow path A5 connected to the wet channel of the evaporative cooler 170. In this embodiment, although the branch point (P3 and P4) is illustrated to have two branch points, they may be branched into three (3) at one branch point. The indoor supply flow path A8 may be connected to the indoor unit 150, may pass through the evaporator 130, and may be supplied to the indoor unit in a cooled state thereof.

The air conditioner may include a discharge flow path A2 discharging indoor air externally as much as an amount of air supplied to the indoor space. The discharge flow path A2 may merge with the regeneration flow path (A9 and A11) at a junction P5 of the regeneration flow path (A9 and A11), and may merge with the regeneration flow path (A9 and A11) to regenerate the dehumidification rotor 180, to be discharged externally.

A water supply flow path W1 connected to a water supply source may be branched into a water supply flow path W2 facing the evaporative condenser 110 and a water supply flow path W3 facing the evaporative cooler 170 at a branch point P2, and water providing latent heat for cooling air passing through the evaporative cooler 170 and water providing latent heat for condensing a refrigerant passing through the evaporative condenser 110 may be provided by the water supply flow paths W2 and W3. Water passing through the evaporative cooler 170 may be drained externally.

Figure 17:
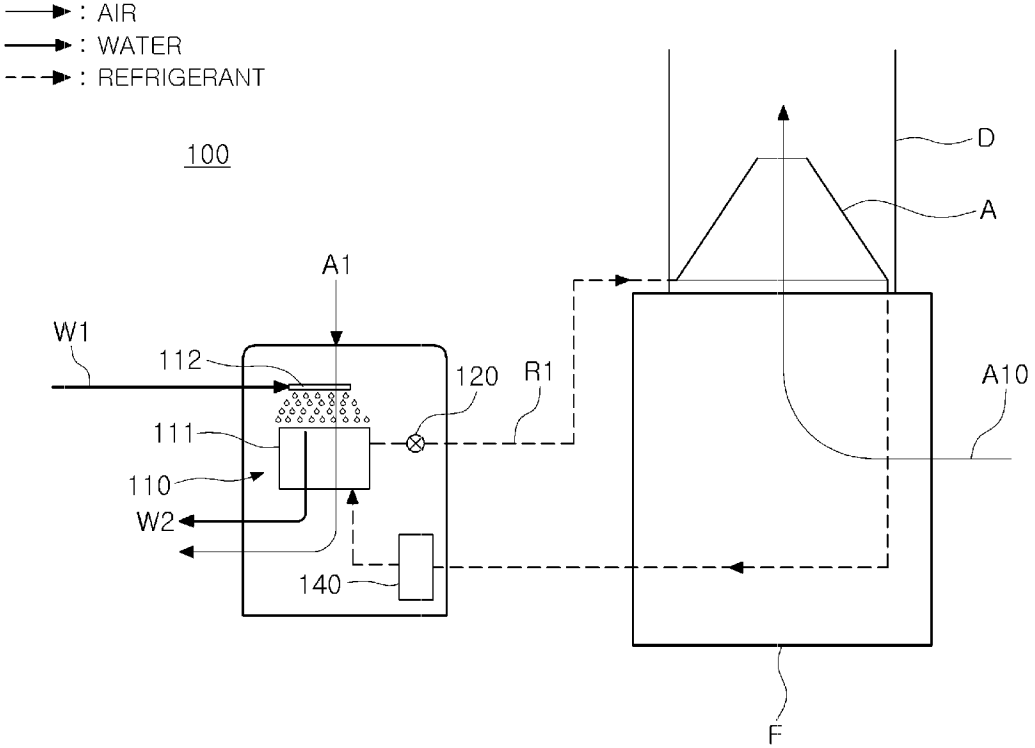
FIG. 17 is a schematic view of an air conditioner according to a sixth embodiment of the present disclosure.

FIG. 17 illustrates a schematic view of a sixth embodiment of the present disclosure. An air conditioner of the sixth embodiment of the present disclosure may include a refrigerant cycle R1 in which a compressed refrigerant is circulated, and the refrigerant cycle R1 may pass through a condenser 110 in which the refrigerant is condensed, and an evaporator 130 in which the refrigerant is evaporated and air is cooled, in the same manner as the first to fifth embodiments.

In the sixth embodiment, an air conditioning space such as a basement may be provided in addition to a living space in which a person resides, and an indoor unit may not be disposed in the living space, which is an indoor space. In FIG. 17, the evaporator 130 may be disposed in the air conditioning space. A circulation flow path A10 drawing indoor air and supplying the indoor air back to the indoor space in a controlled temperature state may be connected to the indoor space, and the evaporator 130 may be disposed on the circulation flow path A10. The evaporator 130 may be disposed on the circulation flow path A10 passing through the air conditioning space. The air conditioning space may include a heater for heating passing air, in addition to the evaporator 130 for cooling the passing air, and may be used as a structure for providing heated or cooled air to the indoor space.

The outdoor unit of the sixth embodiment may be the same as the outdoor unit of the first embodiment, and thus a detailed description thereof will be omitted.

Figure 18A:
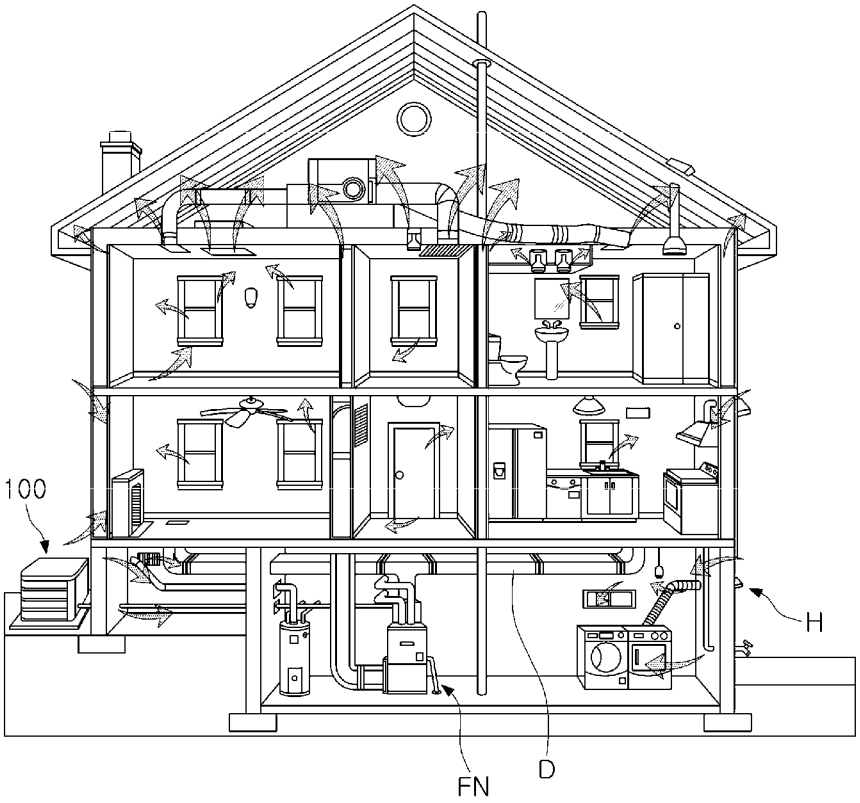
FIG. 18A is a schematic view of a house in which an air conditioner is installed according to a sixth embodiment of the present disclosure.
Figure 18B:
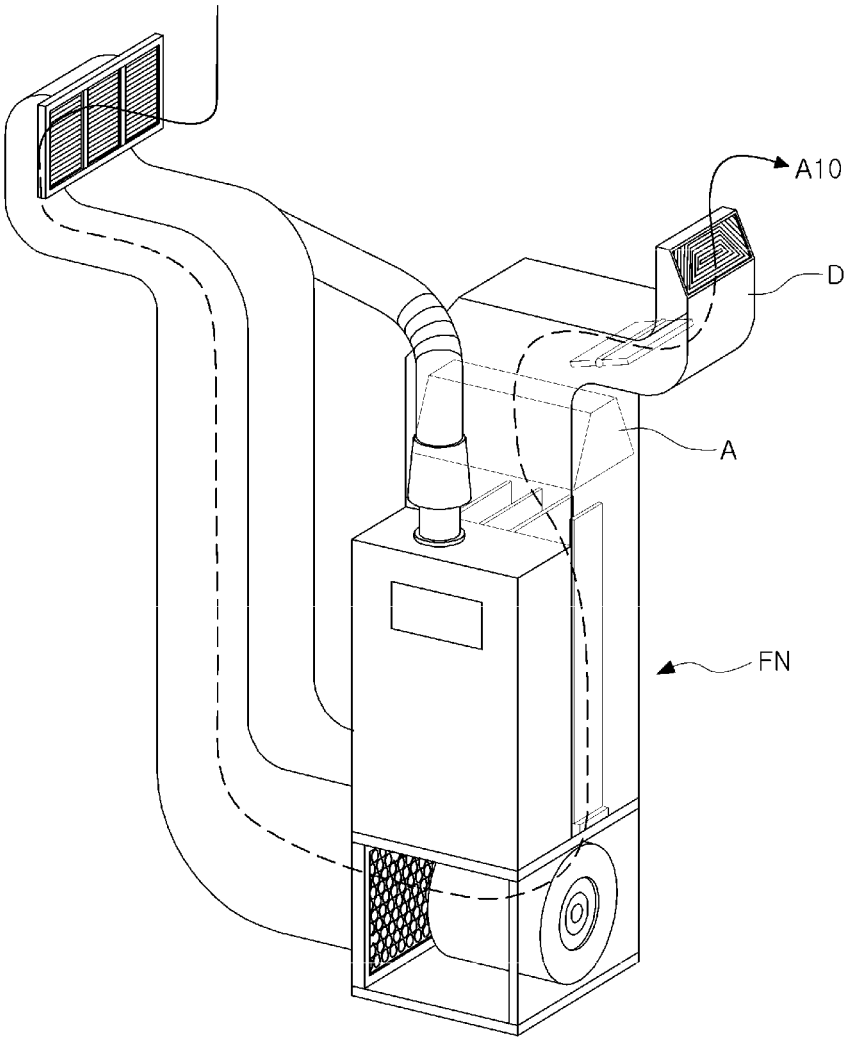
FIG. 18B is a schematic view of a furnace.

FIGS. 18A and 18B illustrate schematic views of a house H and a furnace FN in which a sixth embodiment of the present disclosure is installed. In the sixth embodiment, the air conditioning space may be a furnace FN for heating a house.

As illustrated in FIG. 18A, an outdoor unit may be disposed outside a house H, and a basement of the house H may be provided with a furnace FN provided by inhaling and heating internal air in the house H, and a duct D connecting the furnace FN and an internal space in the house H. In this embodiment, the outdoor unit may have the same structure as the outdoor unit of FIG. 17.

As illustrated in FIG. 18B, the furnace FN, which may be the air conditioning space, may heat a circulation flow path A10 passing through the duct D, and an A coil A equipped with an evaporator 130 (see FIG. 17) may be disposed in the duct D connected to an upper portion of the furnace FN. The A coil A may be connected to an outdoor unit illustrated in FIG. 18A, may evaporate a refrigerant condensed in the outdoor unit as it passes through the A coil A, and may remove heat from air passing through the circulation flow path A10. For example, when the furnace FN is not heated, the air conditioner may forming an internal circulating air flow, e.g., the circulation flow path A10, and may then drive the outdoor unit and the A coil A, to provide cooling to the house H through the duct D of the furnace FN.

Therefore, the air conditioner may including the furnace FN, the A coil, and the outdoor unit, to provide cooling and heating to the house H, as necessary.

Figure 19:
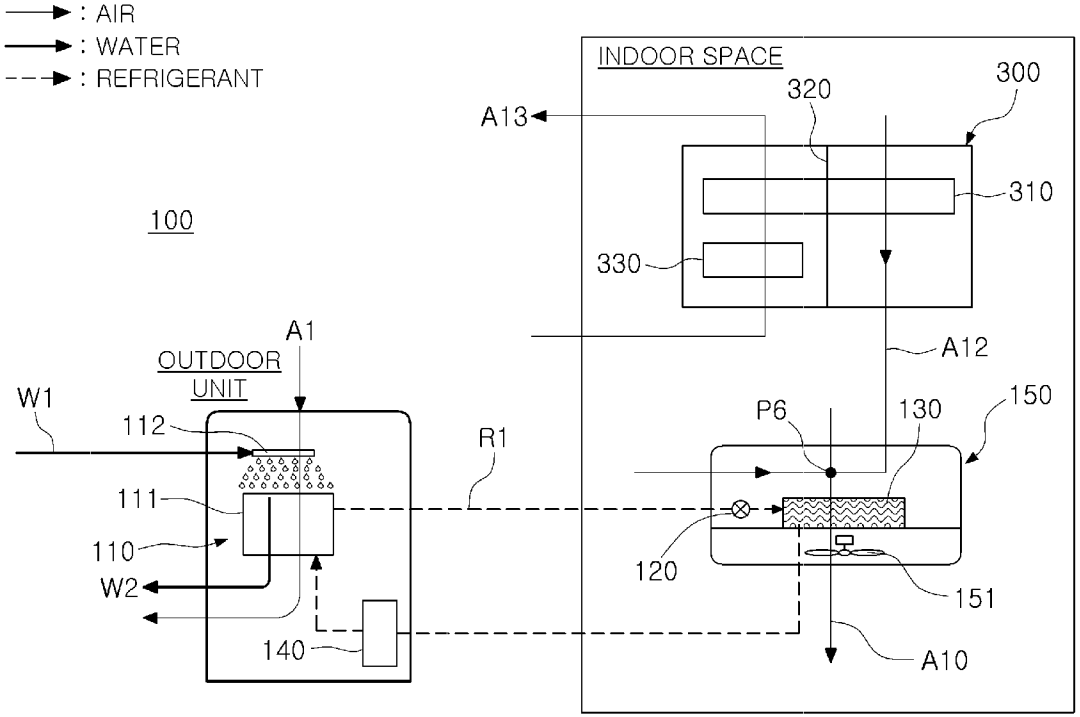
FIG. 19 is a schematic view of an air conditioner according to a seventh embodiment of the present disclosure.

FIG. 19 illustrates a schematic view of a seventh embodiment of the present disclosure. An air conditioner of the seventh embodiment of the present disclosure may include a refrigerant cycle R1 in which a compressed refrigerant is circulated, and the refrigerant cycle R1 may pass through a condenser 110 in which the refrigerant is condensed, and an evaporator 130 in which the refrigerant is evaporated and air is cooled, in the same manner as the first to sixth embodiments.

The seventh embodiment may include a dehumidifying device 300 dehumidifying indoor air, and dehumidifying air passing through the dehumidifying device 300 may merge with other indoor air at a junction P6, and may pass through the evaporator 130. The junction P6 is illustrated to be located before the evaporator 130, but may be located in an intermediate portion of the evaporator 130 or may be merged in an indoor unit 150, after passing air through the evaporator 130, as long as it comes out together in a circulation flow path A10.

The dehumidification device 300 may include a dehumidification rotor 310, an external air flow path A13 through which external air passes, and a heat exchange unit 330 for heating the external air. In the external air flow path A13, the external air may be heated in the heat exchange unit 330, and may then regenerate the dehumidification rotor 310, and the regenerated dehumidification rotor 310 may be disposed on a dehumidification flow path A12 to dehumidify indoor air. The dehumidification flow path A12 and the external air flow path A13 may be partitioned by an inner wall 320, and may not be mixed with each other.

Since an outdoor unit in the seventh embodiment may be the same as the outdoor unit of the first embodiment, a detailed description thereof will be omitted. Since cooling and dehumidification in the seventh embodiment may be implemented with a separate device, e.g., since dehumidification may be implemented with the evaporator 130 and a separate dehumidification rotor 310, and dehumidified air may be provided by the evaporator 130, air having a temperature/humidity, different from dehumidification by a conventional air conditioner, may be provided to the indoor space. In particular, although dehumidification by an air conditioner (an evaporator) may be performed through relationship between temperature and saturated humidity, but in this embodiment, since dehumidification may be performed by the dehumidification rotor 310 regardless of temperature, it is possible to satisfy all the temperature/humidity desired by a user.

In addition, since dehumidified air may be supplied to the evaporator 130, condensed water may not be generated in the evaporator 130. Therefore, mold or bacterial growth caused by moisture of the evaporator 130 may not occur.

Figure 20:
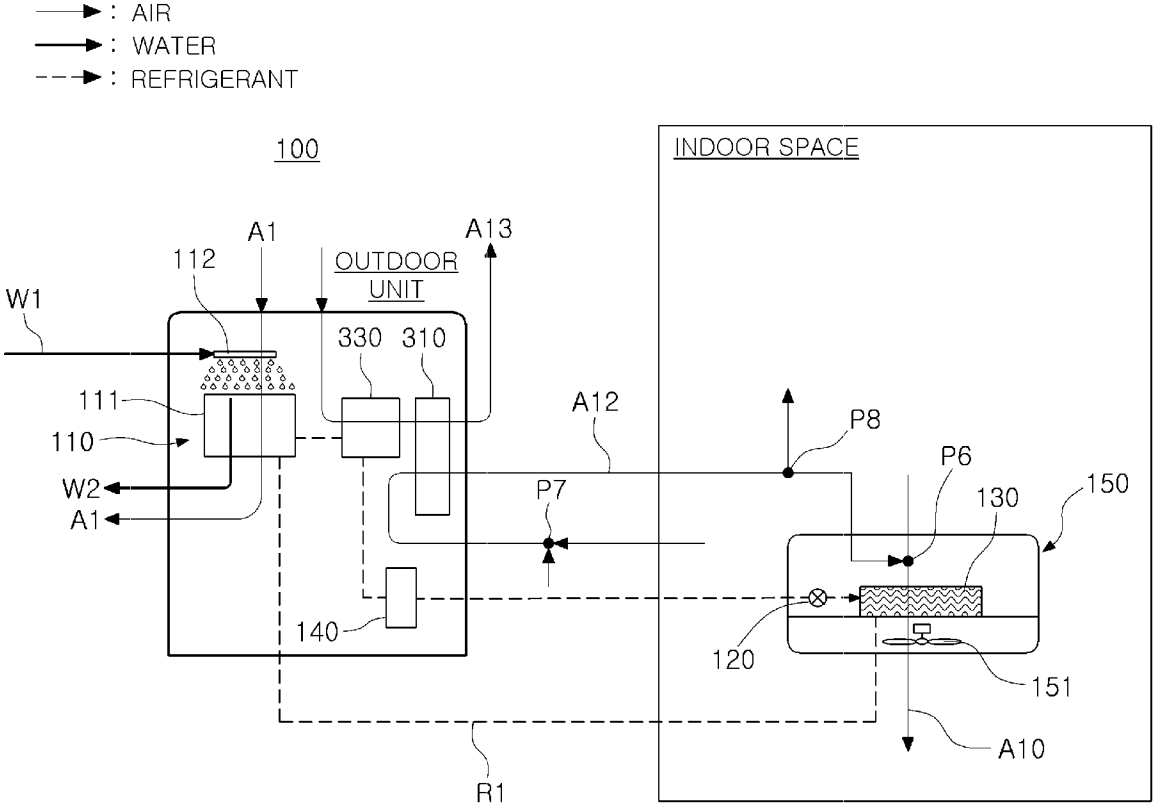
FIG. 20 is a schematic view of an air conditioner according to an eighth embodiment of the present disclosure.

FIG. 20 illustrates a schematic view of an eighth embodiment of the present disclosure. An air conditioner of the eighth embodiment of the present disclosure may include a refrigerant cycle R1 in which a compressed refrigerant is circulated, and the refrigerant cycle R1 may pass through a condenser 110 in which the refrigerant is condensed, and an evaporator 130 in which the refrigerant is evaporated and air is cooled, in the same manner as the first to seventh embodiments. In the refrigerant cycle R1, a heat exchange unit 330' may be disposed between the condenser 110 and a compressor 140, and the heat exchange unit 330' may be disposed in an outdoor unit and may be disposed on an external air flow path A13.

In addition, a dehumidification rotor 310 may be disposed in the outdoor unit, and a portion of the dehumidification rotor 310 may be disposed in a dehumidification flow path A12, and a remaining portion thereof may be disposed in the external air flow path A13. The dehumidification flow path A12 and the external air flow path A13 may be configured to separate from each other, and air introduced from the external air flow path A13 may be configured to pass through the heat exchange unit 330' and the dehumidification rotor 310 sequentially. Air introduced from the external air flow path A13 may pass through the heat exchange unit 330', and may exchange heat with the refrigerant of which temperature has risen by compression, to increase a temperature of the air, and the dehumidification rotor 310 may be regenerated with the air of which temperature has risen by the heat exchange unit 330'.

The dehumidification flow path A12 may be configured to introduce air from the indoor or outdoor space, pass through the dehumidification rotor 310, and supply the air to the indoor space. In this case, the air supplied to the indoor space may be supplied to merge with a junction P6 merging with a circulation flow path A10 at a branch point P8, or may be supplied directly without merging with the circulation flow path A10 to the indoor space, for example, through a duct of a ceiling.

In this embodiment, since air regenerating the dehumidification rotor 310 may be heated by the refrigerant of which temperature is raised by the compressor 140, overall energy efficiency may be improved in view of the facts that a separate heating source is not required for regeneration. In addition, since dehumidification may be performed by the dehumidification rotor 310 as in the seventh embodiment, it is also possible to satisfy all temperature/humidity desired by the user.

Although the present disclosure has been described above with reference to embodiments, the present disclosure is not limited to the above-described embodiments, and may be modified and implemented by those skilled in the art without changing the technical idea of the present disclosure claimed in the claims.

The invention claimed is:

1. An evaporative condenser comprising:

a condensation module including a fluid passage;

a water spray disposed on the condensation module and spraying water passing through the condensation module; and a blower disposed on one side of the condensation module and providing air passing through the condensation module, wherein N header rows are stacked in the condensation module in a third direction, where N is a natural number of 2 or more, wherein the header row includes a first header extending in a first direction and having a flow path formed therein, a second header extending in the first direction and having a flow path formed therein, and a plurality of connection tubes extending in a second direction between the first header and the second header and connecting the flow path of the first header and the flow path of the second header, the first to third directions are different from each other, and the condensation module, the water spray, and the blower are arranged to pass the water sprayed by the water spray and the air provided by the blower between the plurality of connection tubes of the condensation module, wherein, in the condensation module, a fluid inlet is connected to a first header row, and a fluid outlet is connected to an Nth header row, the third direction stacked from the first header row to the Nth header row is opposite to a direction in which the blower supplies the air, and in the condensation module, the fluid inlet is connected to the first header of the first header row, and a flow path hole is formed between the first header of the first header row and the first header of a second header row disposed above the first header row.

2. The evaporative condenser of claim 1, wherein the header rows comprise a 2-1 direction header row in which a fluid flows in the plurality of connection tubes in a 2-1 direction from the first header to the second header, and a 2-2 direction header row in which a fluid flows in the plurality of connection tubes in a 2-2 direction from the second header to the first header, wherein A header rows sequentially stacked from the first header row are the 2-1 direction header row, and wherein the evaporative condenser satisfies $A>M$, and $A+M\leq N$, and $A\geq 2$, where the number of 2-1 or 2-2 direction header rows continuously arranged downwardly from the Nth header row including the Nth header row is M, and A and M are natural numbers.

3. The evaporative condenser of claim 1, wherein the header rows comprise a 2-1 direction header row in which a fluid flows in the plurality of connection tubes in a 2-1 direction from the first header to the second header, and a 2-2 direction header row in which a fluid flows in the plurality of connection tubes in a 2-2 direction from the second header to the first header, wherein A header rows sequentially stacked from the first header row are the 2-1 direction header row, B header rows sequentially stacked on an Ath header row are the 2-2 directional header row, and C header rows sequentially stacked on the Ath header row and a Bth header row are the 2-1 directional header row, wherein the evaporative condenser satisfies $A\geq B$, $A>C$, and $A+B+C\leq N$, where A, B, and C are natural numbers.

4. The evaporative condenser of claim 1, wherein the header rows comprise a 2-1 direction header row in which a fluid flows in the plurality of connection tubes in a 2-1 direction from the first header to the second header, and a 2-2 direction header row in which a fluid flows in the plurality of connection tubes in a 2-2 direction from the second header to the first header, wherein a fluid introduced into the fluid inlet alternately passes through the 2-1 direction header row and the 2-2 direction header row, and is discharged to the fluid outlet, and wherein the number of header rows in the 2-1 or 2-2 direction through which the fluid passes decreases from the fluid inlet to the fluid outlet.

5. The evaporative condenser of claim 1, wherein a fluid inlet is connected to a first header of a first header row, and a fluid outlet is connected to an Nth header row, wherein the plurality of connection tubes include a 2-1 direction connection tube in which a fluid flows in a 2-1 direction from the first header to the second header, and a 2-2 direction connection tube in which a fluid flows in a 2-2 direction from the second header to the first header, wherein a fluid introduced into the fluid inlet alternately passes through the 2-1 direction connection tube and the 2-2 direction connection tube, and is discharged to the fluid outlet, wherein the number of connection tubes through which the fluid passes decreases from the fluid inlet to the fluid outlet.

6. The evaporative condenser of claim 5, wherein, in a header row including the 2-1 direction connection tube and the 2-2 direction connection tube, a baffle is disposed at a corresponding position between the 2-1 direction connection tube and the 2-2 direction connection tube in the first or second header.

7. An air conditioner comprising:

an evaporator, an expansion valve, a compressor, and a condenser, in a refrigerant cycle, wherein the condenser is the evaporative condenser of claim 1.

8. The air conditioner of claim 7, comprising:

an indoor unit in which the evaporator is disposed;

an outdoor unit in which the evaporative condenser is disposed; and a discharge flow path connecting a second blower to an indoor space and supplying indoor air to the second blower.

9. The air conditioner of claim 7, comprising:

a case in which the evaporator, the expansion valve, the compressor, and the evaporative condenser are disposed;

an air flow path connected to an outdoor space to provide air to the evaporative condenser; and a water supply flow path connected to a water supply source to provide water to the evaporative condenser.

10. The air conditioner of claim 9, wherein the evaporator is disposed above the evaporative condenser, and the air conditioner further comprises a condensed water supply flow path formed to supply condensed water formed in the evaporator to the evaporative condenser.

11. The air conditioner of claim 7, comprising:

a supply flow path supplying air from an outdoor space to an indoor space;

a discharge flow path discharging air from the indoor space to the outdoor space; and a ventilation heat exchanger disposed on the supply flow path and the discharge flow path and configured to cross and heat-exchange between the air supplied to the indoor space and the air discharged to the outdoor space, wherein the discharge flow path is connected to the blower.

12. The air conditioner of claim 7, comprising:

a supply flow path supplying air from an outdoor space to an indoor space;

a discharge flow path discharging air from the indoor space to the outdoor space; and a cooler disposed on the supply flow path and including a water spray, wherein the discharge flow path is connected to the blower.

13. The air conditioner of claim 7, further comprising:

a circulation flow path circulating air in an indoor space;

a furnace disposed on the circulation flow path; and a coil A disposed on the circulation flow path above the furnace, wherein the evaporator is the coil A.

14. The air conditioner of claim 7, comprising:

an outdoor unit in which the condenser is disposed; and an indoor unit in which the evaporator is disposed, wherein the outdoor unit includes:

an evaporative cooler disposed on an inflow flow path into which air in an outdoor space is introduced, including a dry channel and a wet channel, and cooling the air passing through the dry channel;

a dehumidification rotor disposed on the inflow flow path before the evaporative cooler and dehumidifying the introduced air; and a heater disposed on a regeneration flow path through which air for regenerating the dehumidification rotor passes, before the dehumidification rotor, to heat the air, wherein the dehumidification rotor is disposed over the regeneration flow path and the inflow flow path, and wherein the inflow flow path passes through the evaporative cooler, and is branched into an indoor supply flow path connected to an indoor space, a condenser supply flow path connected to the condenser, and a cooler supply flow path connected to the wet channel of the evaporative cooler.

15. The air conditioner of claim 13, further comprising:

a dehumidifier including a dehumidification flow path into which air in the indoor space is introduced and connected to an indoor unit, an external air flow path into which air in an outdoor space is introduced and discharged, an inner wall dividing the dehumidification flow path and the external air flow path, a dehumidification rotor disposed across the dehumidification flow path and the external air flow path, and a heater disposed on the external air flow path to heat external air before flowing into the dehumidification rotor, wherein the air in the dehumidification flow path is connected to the evaporator of the indoor unit.

16. The air conditioner of claim 14, wherein a discharge flow path through which air is discharged from an indoor space is connected to the regeneration flow path.

17. The air conditioner of claim 7, comprising:

an outdoor unit in which the condenser is disposed; and a plurality of indoor units in which the evaporator is disposed, respectively.

18. An evaporative condenser comprising:

a condensation module including a fluid passage;

a water spray disposed on the condensation module and spraying water passing through the condensation module; and a blower disposed on one side of the condensation module and providing air passing through the condensation module, wherein N header rows are stacked in the condensation module in a third direction, where N is a natural number of 2 or more, wherein the header row includes a first header extending in a first direction and having a flow path formed therein, a second header extending in the first direction and having a flow path formed therein, and a plurality of connection tubes extending in a second direction between the first header and the second header and connecting the flow path of the first header and the flow path of the second header, the first to third directions are different from each other, and the condensation module, the water spray, and the blower are arranged to pass the water sprayed by the water spray and the air provided by the blower between the plurality of connection tubes of the condensation module, wherein a fluid inlet is connected to a first header row, and a fluid outlet is connected to an Nth header row, wherein the fluid flows from the fluid inlet to the fluid outlet in the plurality of connection tubes alternately in a 2-1 direction from the first header to the second header and in a 2-2 direction from the second header to the first header, and wherein, when flow of a fluid in the plurality of connection tubes is switched from one direction to the other direction, among the 2-1 and 2-2 directions, the condensation module includes a portion in which a sum of cross-sectional areas through which the fluid passes in the one direction is greater than a sum of cross-sectional areas through which the fluid passes in the other direction.

* * * * *